US009624825B1

(12) United States Patent
Lockshaw et al.

(10) Patent No.: US 9,624,825 B1
(45) Date of Patent: Apr. 18, 2017

(54) ORBITAL NON-RECIPROCATING INTERNAL COMBUSTION ENGINE

(71) Applicants: James Lockshaw, Paso Robles, CA (US); Joseph Gerondale, Huntington Beach, CA (US)

(72) Inventors: James Lockshaw, Paso Robles, CA (US); Joseph Gerondale, Huntington Beach, CA (US)

( * ) Notice: Subject to any disclaimer, the term of this patent is extended or adjusted under 35 U.S.C. 154(b) by 0 days.

(21) Appl. No.: 14/957,256

(22) Filed: Dec. 2, 2015

(51) Int. Cl.

| | |
|---|---|
| ***F02B 75/18*** | (2006.01) |
| ***F02B 57/02*** | (2006.01) |
| ***F02B 33/34*** | (2006.01) |
| ***F01B 15/02*** | (2006.01) |
| ***F02B 75/26*** | (2006.01) |
| ***F01P 1/04*** | (2006.01) |
| ***F01P 1/02*** | (2006.01) |
| ***F01P 5/10*** | (2006.01) |

(52) U.S. Cl.
CPC ..... *F02B 57/02* (2013.01); *F01B 15/02* (2013.01); *F01P 1/02* (2013.01); *F01P 1/04* (2013.01); *F01P 5/10* (2013.01); *F02B 33/34* (2013.01); *F02B 75/265* (2013.01)

(58) Field of Classification Search
CPC ..... F01B 15/00; F01B 15/02; F01B 13/00; F01B 13/04; F01B 13/045; F02B 75/265
See application file for complete search history.

(56) References Cited

U.S. PATENT DOCUMENTS

| | | | |
|---|---|---|---|
| 868,100 | A | 10/1907 | Krehbiel |
| 1,109,270 | A | 9/1914 | Wallis |

(Continued)

FOREIGN PATENT DOCUMENTS

| | | | |
|---|---|---|---|
| JP | 61-154464 | A | 7/1986 |
| JP | 6-33784 | A | 2/1994 |
| WO | 2013/055881 | A | 4/2013 |

OTHER PUBLICATIONS

Japanese Office Action, dated Oct. 17, 2016, for Japanese Application No. 2014-535862, 8 pages.

(Continued)

*Primary Examiner* — Kevin Lathers
(74) *Attorney, Agent, or Firm* — Seed IP Law Group LLP

(57) ABSTRACT

A combustible fluid-operated orbital engine having sets of cooperating cylinder and piston members with respective parallel axes of rotation. Respective cylinder and piston carrier wheels with respective axes of rotation parallel to the piston/cylinder axes of rotation carrying the pistons/cylinders orbitally and at all times in opposed relation on a common longitudinal axis along intersecting counter paths. Redundant belts/sprockets supported by the cylinder and piston carrier wheels rotate the pistons/cylinders counter to their circular motion direction to maintain their opposed relation for their periodic interfittment when their respective paths intersect. A combustible fluid supply is provided to the cylinder member for combustion coincident with the periodic interfittment. An air supply is provided to the cylinder member for purging exhaust gases and/or supercharging combustion gases. A sealing system that includes a non-metallic flexible seal is located either proximate the entry of each cylinder or proximate an end portion of each piston.

20 Claims, 24 Drawing Sheets

(56) References Cited

U.S. PATENT DOCUMENTS

| | | | | |
|---|---|---|---|---|
| 1,215,922 | A * | 2/1917 | Fasnacht | F02B 57/08 123/44 B |
| 1,705,130 | A | 3/1929 | McKlusky | |
| 1,742,706 | A | 1/1930 | Hermann | |
| 1,817,370 | A | 8/1931 | Hammerstrom | |
| 2,078,748 | A | 4/1937 | Wenzel | |
| 2,894,496 | A | 7/1959 | Townsend | |
| 3,043,234 | A | 7/1962 | Poulin | |
| 3,084,562 | A | 4/1963 | Fitzpatrick | |
| 3,105,473 | A | 10/1963 | Johns et al. | |
| 3,353,519 | A | 11/1967 | Reichart | |
| 3,550,565 | A | 12/1970 | Sanchez et al. | |
| 3,942,913 | A * | 3/1976 | Bokelman | F01B 1/0644 310/24 |
| 4,236,496 | A | 12/1980 | Brownfield | |
| 4,432,314 | A | 2/1984 | Pelekis | |
| 4,530,316 | A | 7/1985 | Morrison | |
| 4,531,481 | A | 7/1985 | Haynes | |
| 4,836,149 | A | 6/1989 | Newbold | |
| 5,343,832 | A | 9/1994 | Murray | |
| 6,457,443 | B1 | 10/2002 | Lillbacka | |
| 6,526,925 | B1 | 3/2003 | Green, Jr. | |
| 6,591,791 | B2 | 7/2003 | De Bei | |
| 6,615,793 | B1 | 9/2003 | Usack | |
| 6,705,202 | B2 | 3/2004 | Harcourt et al. | |
| 6,779,433 | B2 | 8/2004 | Brosch et al. | |
| 7,341,042 | B1 | 3/2008 | Chung et al. | |
| 7,721,687 | B1 * | 5/2010 | Lockshaw | F02B 57/08 123/52.1 |
| 8,161,924 | B1 | 4/2012 | Lockshaw et al. | |
| 8,555,830 | B2 * | 10/2013 | Lockshaw | F02B 57/02 123/193.1 |
| 2004/0099228 | A1 | 5/2004 | Roberts | |
| 2008/0283002 | A1 | 11/2008 | Mantheakis et al. | |

OTHER PUBLICATIONS

International Search Report, mailed Mar. 25, 2013, for International Application No. PCT/US2012/059695, 3 pages.

Lockshaw et al., "Orbital, Non-Reciprocating, Internal Combustion Engine," Notice of Allowance mailed Dec. 28, 2011, for U.S. Appl. No. 12/567,759, 12 pages.

* cited by examiner

ORBITAL NON-RECIPROCATING INTERNAL COMBUSTION ENGINE

BACKGROUND

Technical Field

The present disclosure relates generally to internal combustion engines, and more specifically, to orbital, non-reciprocating internal combustion engines.

Description of the Related Art

The Otto Cycle engine is a reciprocating internal combustion engine. Many of the key work-producing components of the Otto Cycle engine reciprocate, that is they are required to move in a first direction, stop, and then move in a second, opposite direction in order to complete the cycle. In the Otto Cycle engine, there are four changes of direction of the piston assembly in effecting a single power stroke. Piston assemblies (e.g., pistons, rings, wrist pins and connecting rods) travel up into their respective cylinders at a changing rate of speed to top dead center (i.e., to the end of the stroke), where they stop and then return down the cylinder to the bottom of the stroke. The connecting rod, traveling with the piston and articulating at the wrist pin and orbiting at the crankshaft presents a changing angular force that results in side loading of the piston against the cylinder wall. This causes frictional losses. Because of acceleration and deceleration of the piston components in their movements, the internal combustion reciprocating engine requires a flywheel to moderate these energy surges, but this is an imperfect solution and there remain energy-consuming effects.

The Otto Cycle engine also employs the piston/cylinder relationship to pump air into the cylinder (through reciprocating valves) to support combustion and then to pump the exhaust gases out of the cylinder through reciprocating valves. A significant amount of the engine power is used to achieve the pumping action and two revolutions of the crankshaft are required to effect one power stroke.

BRIEF SUMMARY

A combustible fluid-operated orbital engine may be summarized as including one or more cylinders in which each cylinder has a longitudinal axis and is carried on a pair of rotating cylinder carrier wheels for orbital motion, the one or more cylinders receive a combustible fluid therein, the pair of rotating cylinder carrier wheels being rotatable about an axle along an first axis of rotation; one or more corresponding pistons carried on a pair of counter-rotating piston carrier wheels for opposite orbital motion, the pair of counter-rotating piston carrier wheels being rotatable about an axle along an second axis of rotation parallel to the first axis of rotation, each of the one or more pistons having a cooperating cylinder and having throughout its movement the same longitudinal axis as its cooperating cylinder to oppose and sequentially enter and completely withdraw from its cooperating cylinder on the same longitudinal axis; a first belt which mechanically links a first one of the pair of rotating cylinder carrier wheels to a first one of the pair of counter-rotating piston carrier wheels such that the first one of the pair of rotating cylinder carrier wheels rotates in a first direction when the first one of the pair of counter-rotating piston carrier wheels rotates in a second direction opposite the first direction; and a second belt which mechanically links a second one of the pair of rotating cylinder carrier wheels to a second one of the pair of counter-rotating piston carrier wheels such that the second one of the pair of rotating cylinder carrier wheels rotates in the first direction when the second one of the pair of counter-rotating piston carrier wheels rotates in the second direction opposite the first direction. Each of the first belt and the second belt may include cog belts.

The combustible fluid-operated orbital engine may further include respective sprocket and belt assemblies supported by each of the cylinder carrier wheels and piston carrier wheels and operative to rotate the one or more cylinders and the one or more pistons counter to their circular motion direction to maintain their opposed relation for periodic interfittment when their respective paths intersect.

The combustible fluid-operated orbital engine may further include a combustible fluid supply to the one or more cylinders in timed relation with piston entry into the cylinder for compression, detonation, and exhaust. The one or more cylinders may each include a cylinder head coupled to a cylinder axle, the cylinder axle including a fuel tube for delivering fuel to a fuel injector nozzle operatively coupled to the cylinder.

The combustible fluid-operated orbital engine may include an air supply to the one or more cylinders in timed relation with piston entry into the cylinder for at least one of purging exhaust gases or supercharging combustion gases. The one or more cylinders may each include a cylinder head coupled to a cylinder axle, the cylinder axle including an air tube for delivering air to an air injector nozzle operatively coupled to the cylinder.

The combustible fluid-operated orbital engine may further include a combustible fluid detonator operatively coupled to each piston.

The combustible fluid-operated orbital engine may further include a blower assembly which controls at least one of pressure, air quality, or cooling of the one or more pistons and the one or more cylinders during operation of the combustible fluid-operated orbital engine. Each of the one or more cylinders may include a sealing system located proximate an entry of the cylinder, the sealing system comprising a non-metallic flexible seal. For each cylinder, the non-metallic flexible seal may include polytetrafluoroethylene. For each cylinder, the non-metallic flexible seal may include polytetrafluoroethylene filled with a percentage of glass. Each of the one or more pistons may include a sealing system located proximate an end portion of the piston, the sealing system including a non-metallic flexible seal.

The combustible fluid-operated orbital engine may further include a sealing system coupled to one of: each of the one or more cylinders or each of the one or pistons, the sealing system including a non-metallic flexible seal and a seal energizer. The one or more cylinders may include a plurality of cylinders and the one or more pistons may include a plurality of pistons, wherein the longitudinal axis of each piston-cylinder pair may be at all times parallel to the respective longitudinal axes of each other cooperating cylinder and piston pairs.

A method of operating a combustible fluid-operated orbital engine may be summarized as including disposing plural sets of cooperating cylinder and piston members having respective parallel axes of rotation at all times in opposed relation on a common longitudinal axis; supporting the cylinder members on a pair of cylinder carrier wheels; supporting the piston members on a pair of piston carrier wheels; mechanically linking a first one of the pair of cylinder carrier wheels to a first one of the pair of piston carrier wheels by a first belt such that the first one of the pair of cylinder carrier wheels rotates in a first direction when the first one of the pair of piston carrier wheels rotates in a second direction opposite the first direction; mechanically linking a second one of the pair of cylinder carrier wheels to a second one of the pair of piston carrier wheels by a second belt such that the second one of the pair of rotating cylinder carrier wheels rotates in the first direction when the second one of the pair of counter-rotating piston carrier wheels rotates in the second direction opposite the first direction. rotating the pair of cylinder carrier wheels and the pair of piston carrier wheels circularly along intersecting counter paths about axes of rotation parallel to the members' axes of rotation while simultaneously rotating the members counter to their circular motion in orbital relation sufficiently to maintain their disposition on the common longitudinal axis, wherein the rotating causes periodically interfittment of each set of cooperating cylinder and piston members where their respective paths intersect; and supplying a combustible fluid in the cylinder member for detonation responsive to the members' interfittment in engine operating relation.

The method may further include driving rotation of each member with a respective sprocket and belt assembly carried by its respective carrier wheel.

The method may further include supplying air in the cylinder member to at least one of purge exhaust gases or supercharge combustion gases.

The method may further include detonating, by a combustible fluid detonator coupled to the piston member, the combustible fluid while the piston member may be positioned within a corresponding cylinder member.

The method may further include providing a sealing system coupled to one of: each of the cylinder members or each of the piston members, the sealing system including a non-metallic flexible seal.

BRIEF DESCRIPTION OF THE SEVERAL VIEWS OF THE DRAWINGS

In the drawings, identical reference numbers identify similar elements or acts. The sizes and relative positions of elements in the drawings are not necessarily drawn to scale. For example, the shapes of various elements and angles are not necessarily drawn to scale, and some of these elements may be arbitrarily enlarged and positioned to improve drawing legibility. Further, the particular shapes of the elements as drawn, are not necessarily intended to convey any information regarding the actual shape of the particular elements, and may have been solely selected for ease of recognition in the drawings.

DETAILED DESCRIPTION

Figure 1:
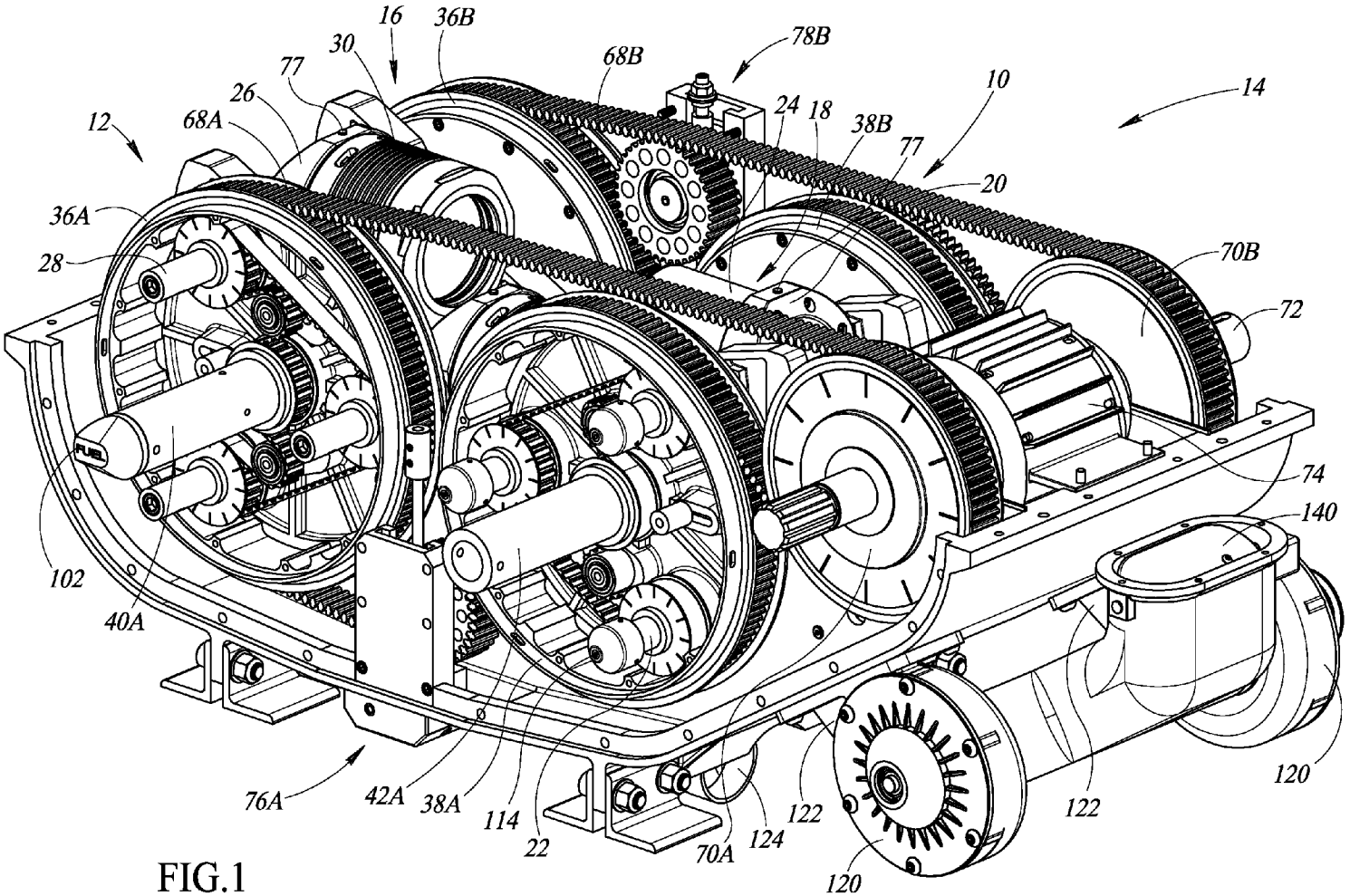
FIG. 1 is a perspective view of a cylinder drive wheel assembly and a piston drive wheel assembly of an engine according to a three cylinder implementation.
Figure 2A:
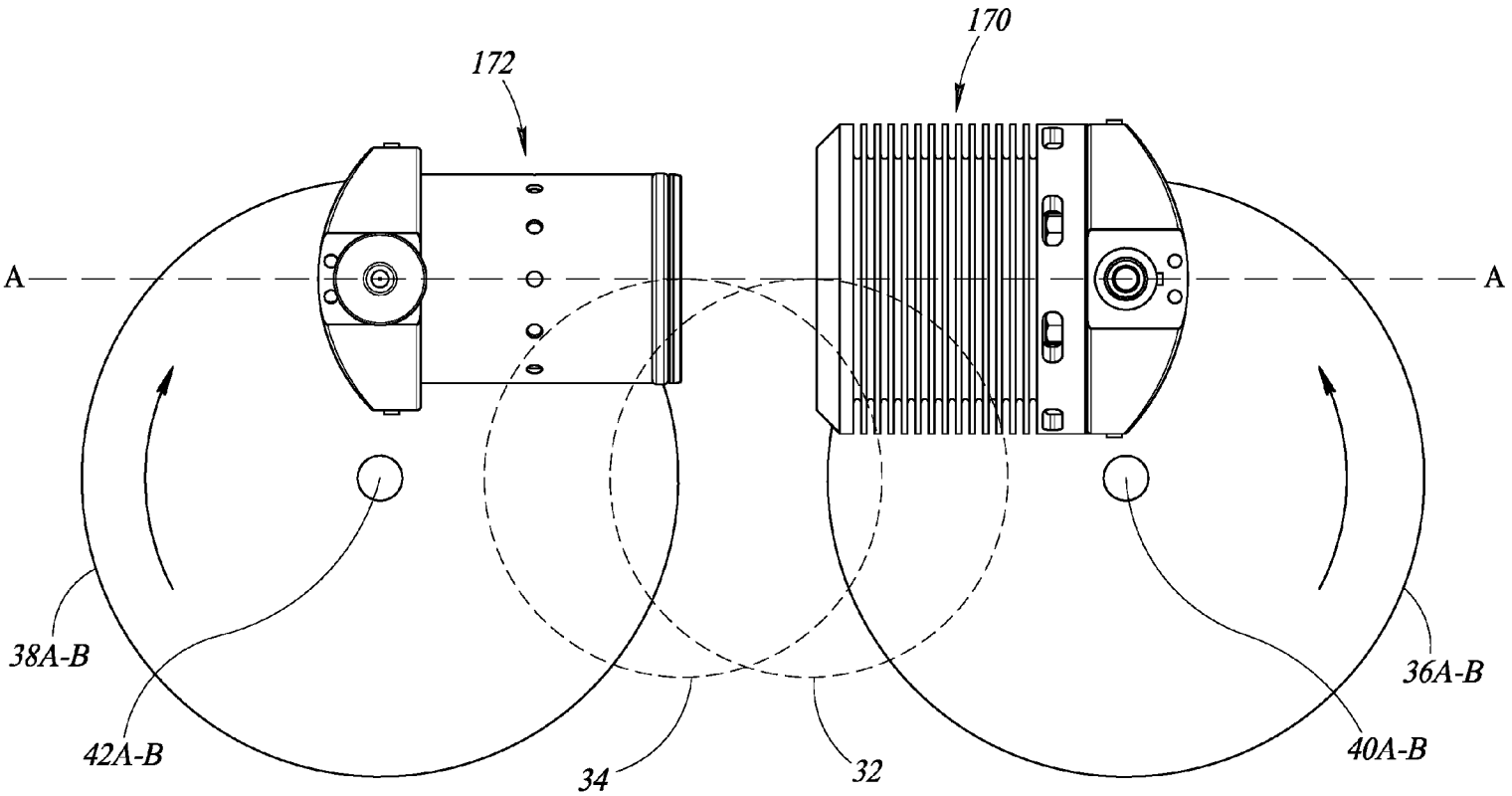
FIGS. 2A-2D are progressive schematic depictions of a side elevation view of the engine with the piston and cylinder approaching, interfitting, and withdrawing as a result of their travel paths as defined by their respective carrier wheels, according to one illustrated implementation.
Figure 2B:
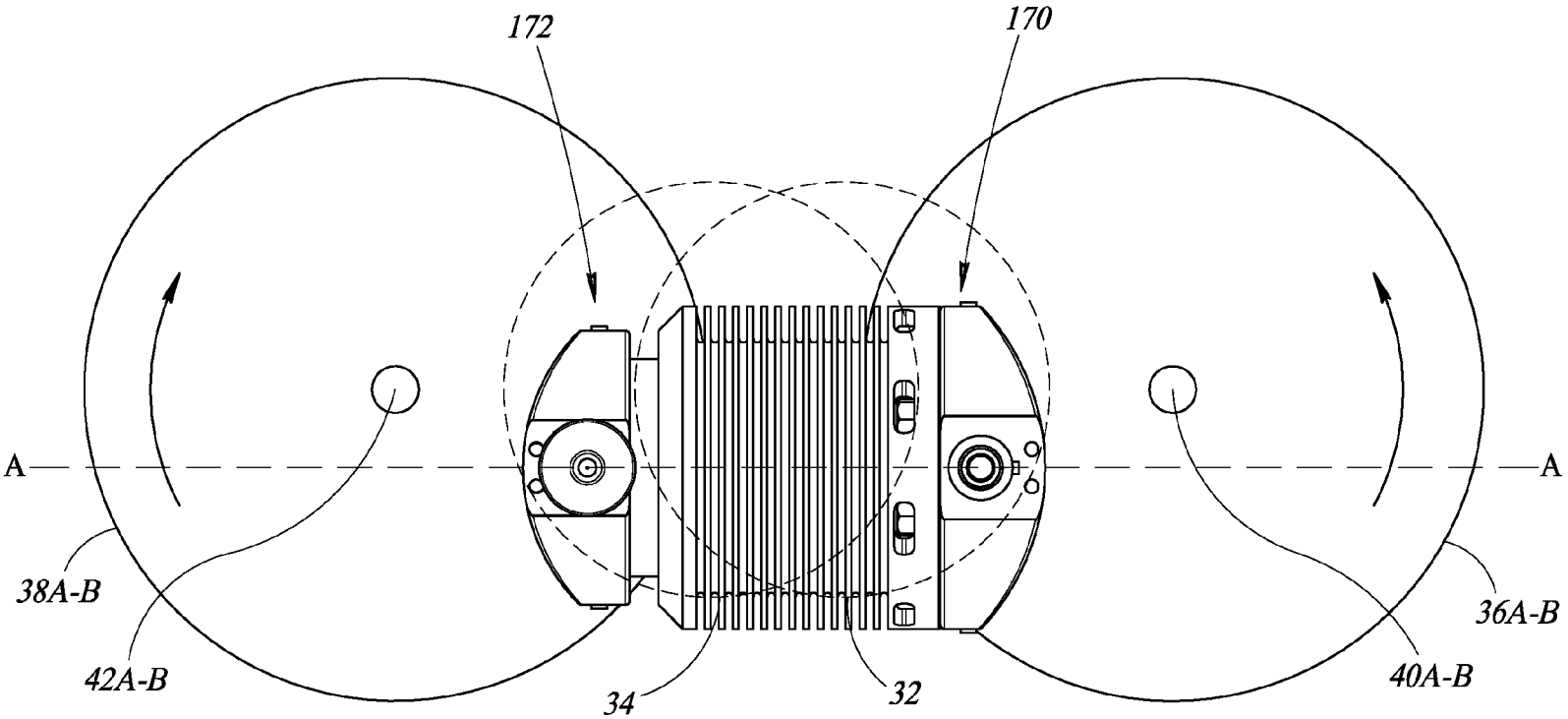
Figure 2C:
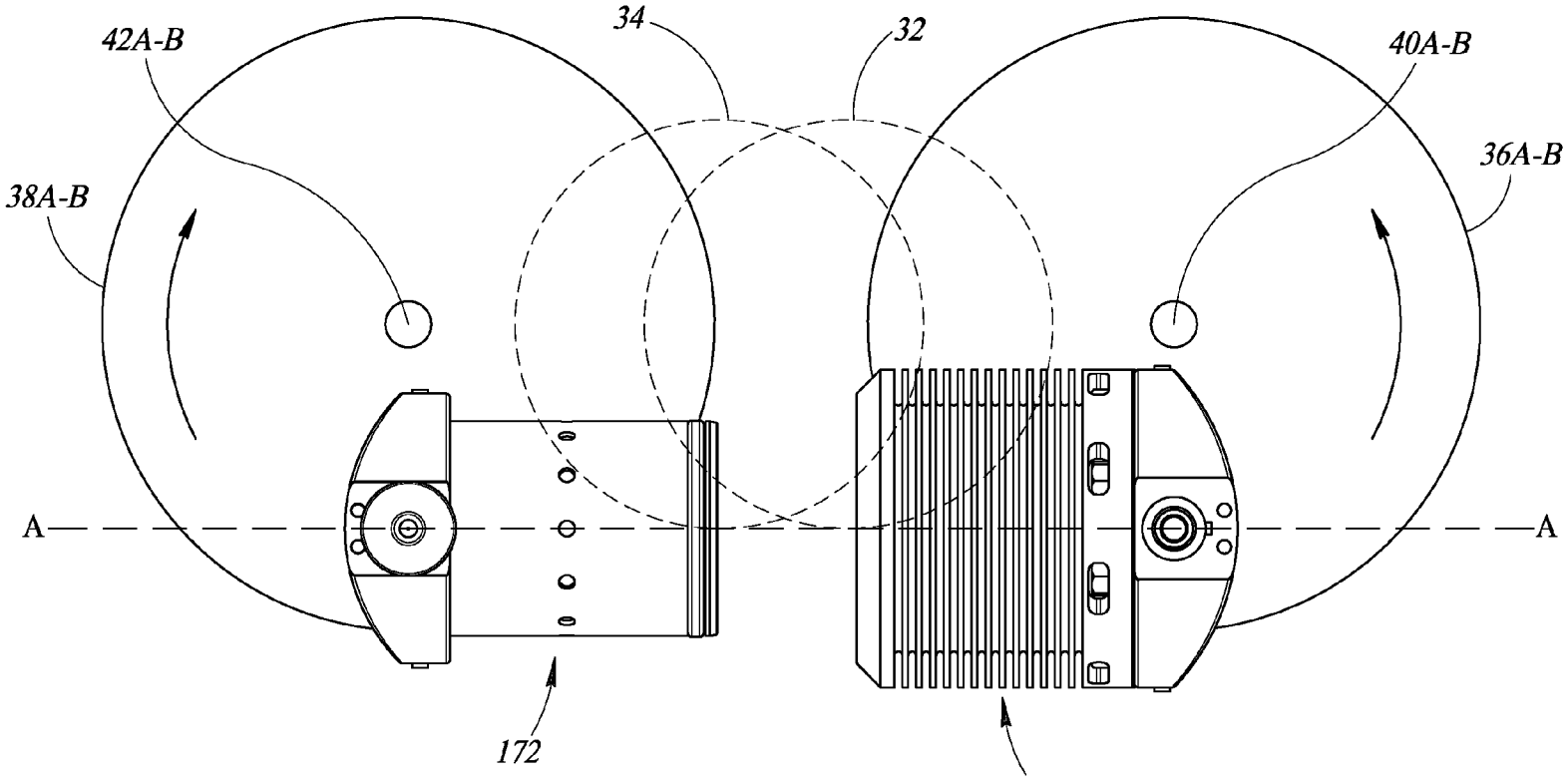
Figure 2D:
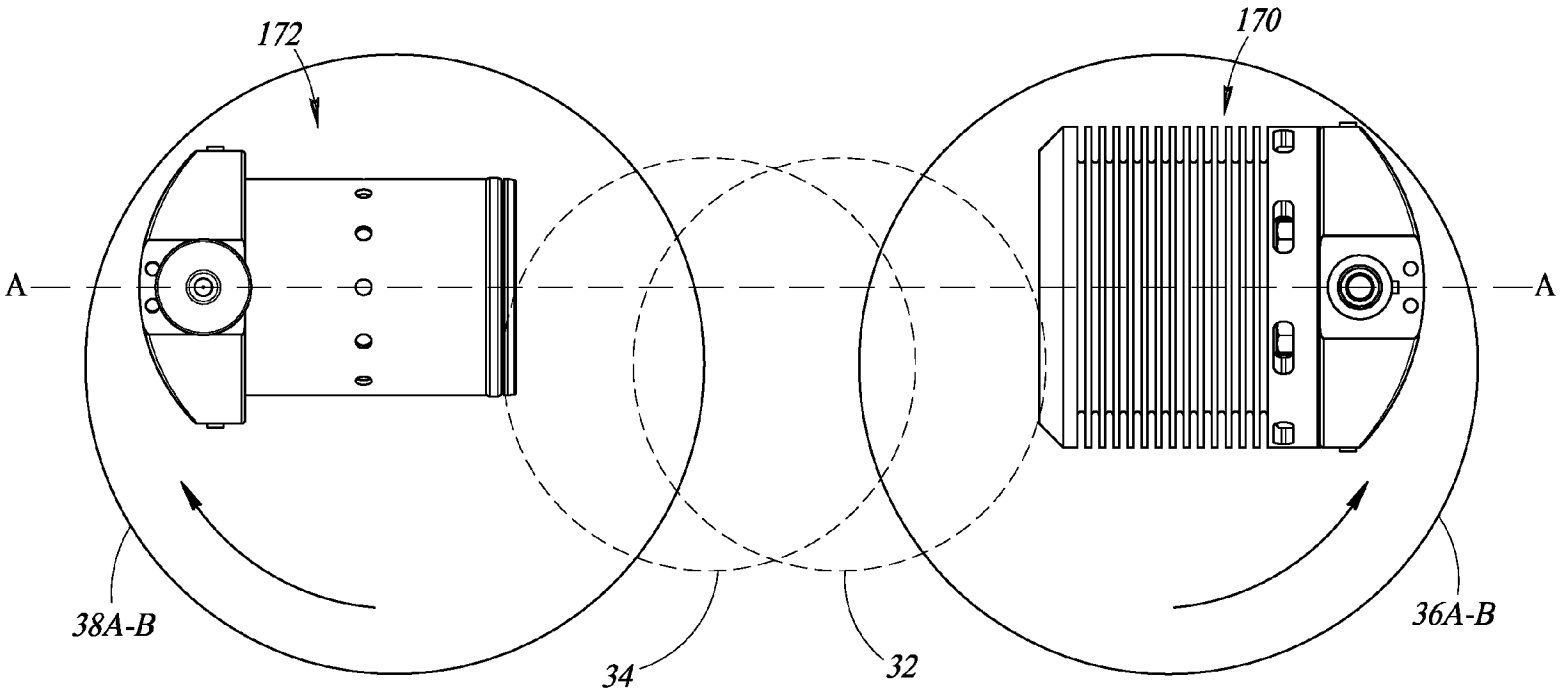

In the following description, certain specific details are set forth in order to provide a thorough understanding of various disclosed implementations. However, one skilled in the relevant art will recognize that implementations may be practiced without one or more of these specific details, or with other methods, components, materials, etc. In other instances, well-known structures associated with computer systems, server computers, and/or communications networks have not been shown or described in detail to avoid unnecessarily obscuring descriptions of the implementations.

Unless the context requires otherwise, throughout the specification and claims that follow, the word "comprising" is synonymous with "including," and is inclusive or open-ended (i.e., does not exclude additional, unrecited elements or method acts).

Reference throughout this specification to "one implementation" or "an implementation" means that a particular feature, structure or characteristic described in connection with the implementation is included in at least one implementation. Thus, the appearances of the phrases "in one implementation" or "in an implementation" in various places throughout this specification are not necessarily all referring to the same implementation. Furthermore, the particular features, structures, or characteristics may be combined in any suitable manner in one or more implementations.

As used in this specification and the appended claims, the singular forms "a," "an," and "the" include plural referents unless the context clearly dictates otherwise. It should also be noted that the term "or" is generally employed in its sense including "and/or" unless the context clearly dictates otherwise.

The headings and Abstract of the Disclosure provided herein are for convenience only and do not interpret the scope or meaning of the implementations.

The engine design of the present disclosure, sometimes referred to herein as an orbital engine, changes some of the basic mechanical principles of the Otto Cycle engine. Instead of a reciprocating motion, the orbital engine design employs a non-reciprocating orbital motion of pistons and cylinders. Thus, the orbital engine has no engine block, no crankshaft or associated connecting rods, no separate flywheel, intake or exhaust valves or water pump, nor their supporting hardware.

Instead, the orbital engine's pistons and cylinders are each attached to their own respective carrier or drive wheels. By arranging and maintaining the relationship and the position of the piston drive wheels relative to the position of the cylinder drive wheels, an overlap of the piston/cylinder paths can be achieved. This union of the piston and cylinder paths represents the "stroke" of the orbital engine. The piston wheels and the cylinder wheels rotate in opposite directions on their respective (and parallel) axes, and the individual pistons and cylinders carried thereby are in orbital motion, circling the wheel axes but at the same time counter rotating about their own respective axes to keep, at all times, in position for interfittment. That is, respective sets of pistons and cooperating cylinders share a common longitudinal axis regardless of their relative positioning on their respective wheels.

A working unit, a set comprising a piston and mating cylinder, always stays aligned throughout 360 degrees of rotation of the piston wheels and the cylinder wheels. Simply put, a piston always points toward its associated cylinder in the set or unit and a cylinder is pointed open towards its associated piston. There are thus no angular forces pushing the piston against the cylinder walls and causing friction. This is in contrast to radial piston/cylinder disposition systems where the axial alignment is transitory and local. In the orbital engine, the aforementioned longitudinal alignment, wherein the cylinder/piston angle is no greater than about 0 degrees, enables both compression and combustion forces to be directly in line with piston/cylinder center lines as further explained below.

The pistons and cylinders of the present disclosure are always oriented the same way, for interfittment along a common longitudinal axis, avoiding side loading. In some implementations, the pistons and cylinders of the orbital engine are maintained oriented by sprockets and toothed belts to keep them in the desired relative positions.

Unlike the Otto Cycle engine whose maximum lever arm or torque is achieved when the piston is half-way through its power stroke, the orbital engine increases its lever arm through the full distance of the power stroke. The orbital engine lever arm is greater than the Otto Cycle engine lever arm; and the stroke is longer (as a factor of a typical cylinder bore), and each cylinder completes a power stroke with each, not every other, revolution of the engine, allowing the orbital engine to achieve high horsepower at low RPM's, meaning more moderate engine speeds, more work and less friction wear in operating the engine. These mechanical advantages add markedly to fuel efficiency.

Both the cylinder and the piston carrier assemblies act as linked flywheels. All engine components having mass are rotating/orbiting about the wheels' axes of rotation and are always in balance. Because pistons and cylinders are orbiting and thus not changing their direction of motion or their velocity (except in relation to engine speed), energy that is lost in Otto Cycle reciprocating engines is conserved in the orbital engine.

The orbital engine is in some implementations operable by a liquid combustible fuel such as gasoline, diesel, biodiesel, etc. In other implementations, the orbital engine is operable with gaseous combustible fluids such as natural gas, propane, etc. As described below, some implementations do not require intake or exhaust valves, which offers increased engine efficiency and simplicity.

For an orbital engine, friction, pumping, cooling, and even vibration losses are reduced substantially, perhaps as much as 50%, compared to current designs. Add in combustion efficiency, lowered weight, and reduced manufacturing costs due to simplicity and inexpensive materials relative to current Otto Cycle engines, and it is apparent that the orbital engine is a giant step forward in meeting the world's engine modernization needs.

For an orbital engine of the present disclosure, both pistons and cylinders are in motion towards each other for the compression stroke and in motion away from each other for the power stroke. The velocities of the pistons and cylinders are combined to effectively double their relative motion and, because the pistons and cylinders are always in line, the stroke is not limited by the angle of a connecting rod as is the case with reciprocating engines. A longer stroke to bore ratio has a smaller surface area exposed to the combustion chamber gasses compared to a shorter stroke to bore ratio. The smaller area leads directly to reduced in-cylinder heat transfer and increased energy transfer. The stroke/bore ratio for the majority of internal combustion engines is between 0.9 and 1.2, whereas the ratio for the orbital engines discussed herein may be from 1.5 to 3.0, for example. These greater ratios insure a more complete combustion and cleaner exhaust.

Further, because the pistons and cylinders in the orbital engine totally disengage, there is no need for exhaust or intake valves, or the machinery to operate them. In 2-cycle engines, part of the "stroke" is used to achieve the "breathing" of the engine. In the orbital engine, which is a 2-cycle engine, when the piston and cylinder separate at the end of the power stroke, the full diameter of the cylinder is open for the exhaust to exit at the bottom of the piston/cylinder chamber and is assisted by the cooling and ventilating air that is applied at the top of the chamber.

Both the cylinder wheels and the piston wheels are in balance and the motion dynamics do not require a separate flywheel to mitigate power surges, as each wheel is a flywheel. When the engine is running, there is minimal to no vibration, evidence of its efficiency.

Engine component drive systems in some designs employ gears to control the positioning of the pistons and cylinders. As can be appreciated, gears are heavy and require oil to lubricate them. In addition, gears require somewhat of a loose fit which allows for "backlash," which effects accuracy. Other shortcomings of gear drive systems are the need for large, expensive oil seals in the gearbox and the potential for leakage.

In the implementations discussed herein, gears are replaced with cog belts and pulleys. As a non-limiting example, such cog belts may be made from polyurethane or other suitable material(s). In such implementations, no oil is required and there is no "backlash." As discussed further below, to insure reliability there is a duplication of the drive belts on two sides of the orbital engine. If there is a belt failure, the engine will not be damaged and will continue to operate until the belt is replaced. Sensors may detect any belt failure and limit the power output of the engine until the belt is replaced. A further advantage of the belt drive system relative to a gear drive system is that belt tensioning and belt alignment can be incorporated to insure accuracy of the piston cylinder alignment.

In some implementations, to achieve maximum engine efficiency a pressurized air injection system is provided which purges the exhaust gases and supercharges the combustion gases.

In some implementations, the orbital engine incorporates non-metallic flexible seals (e.g., polytetrafluoroethylene (PTFE) (25% glass fiber fill)) that are designed to withstand the heat and pressure of the combustion process, and require no lubrication. As a non-limiting example, the seals may be formed out of polytetrafluoroethylene (PTFE) (25% glass fiber fill), or other suitable material(s). These seals have very little compression leakage, and there is little wear on the pistons as there is no contact between the cylinders and pistons, further improving efficiency. This type of seal has a long life span and can be replaced as easy as changing spark plugs, if required. The seals may be included in the piston (FIGS. 16-19) or in the entry of each of the cylinders. In implementations wherein the seals are positioned in the pistons, the combustion heat is isolated from the body of the piston as only the seal contacts the wall of the cylinder.

The adoption of the non-lubrication piston seals and the elimination of the use of oil in the drive mechanism makes the orbital engine of the present disclosure the only internal combustion engine in the world which operates on air and fuel only. Added to the fact that the compression and power stroke are created without any reciprocating motion makes it truly efficient and unique. The various features of the orbital engine of the present disclosure are discussed in detail below with reference to the drawings.

Figure 3:
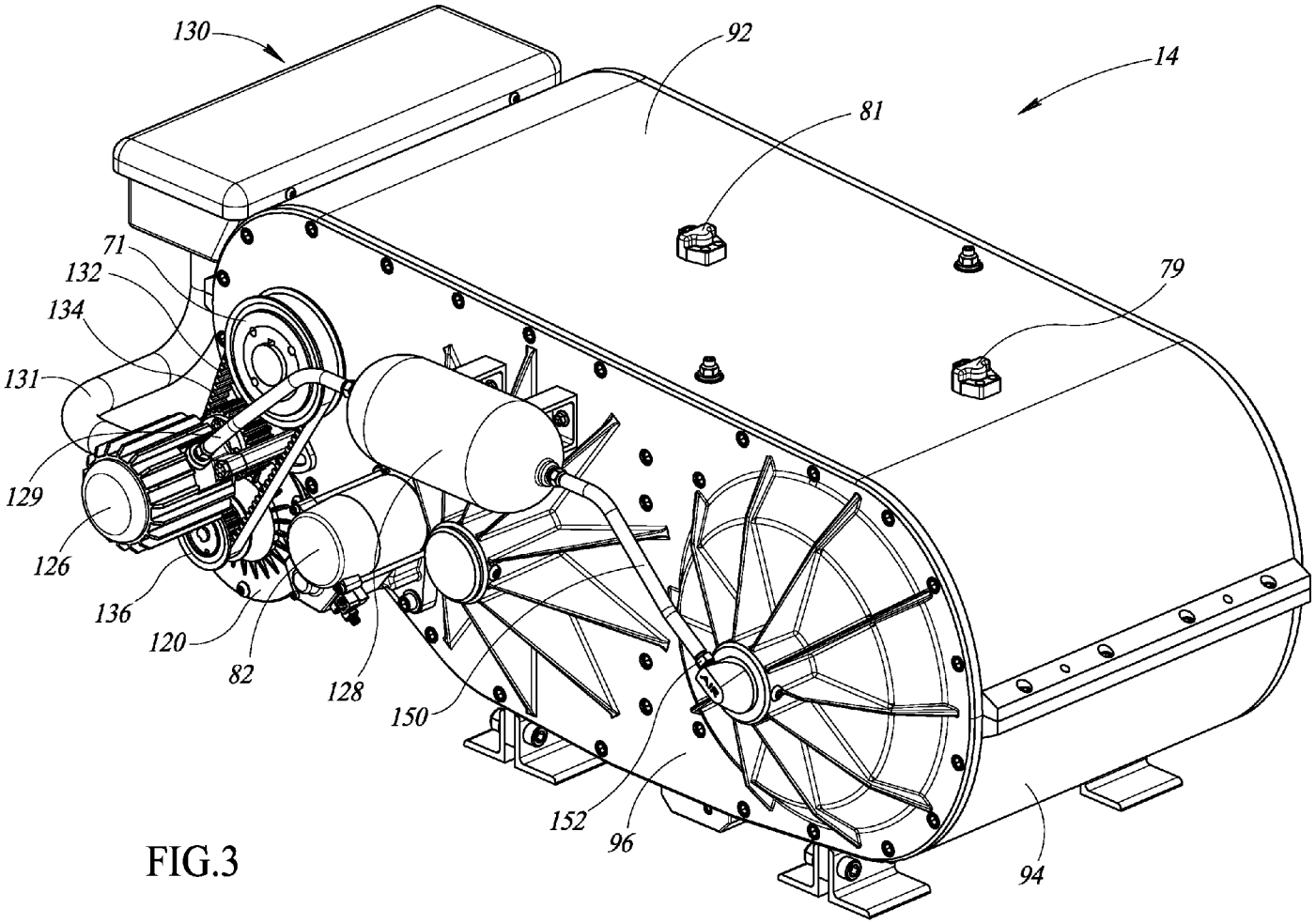
FIG. 3 is a front-left perspective view of the engine, according to one illustrated implementation.
Figure 4:
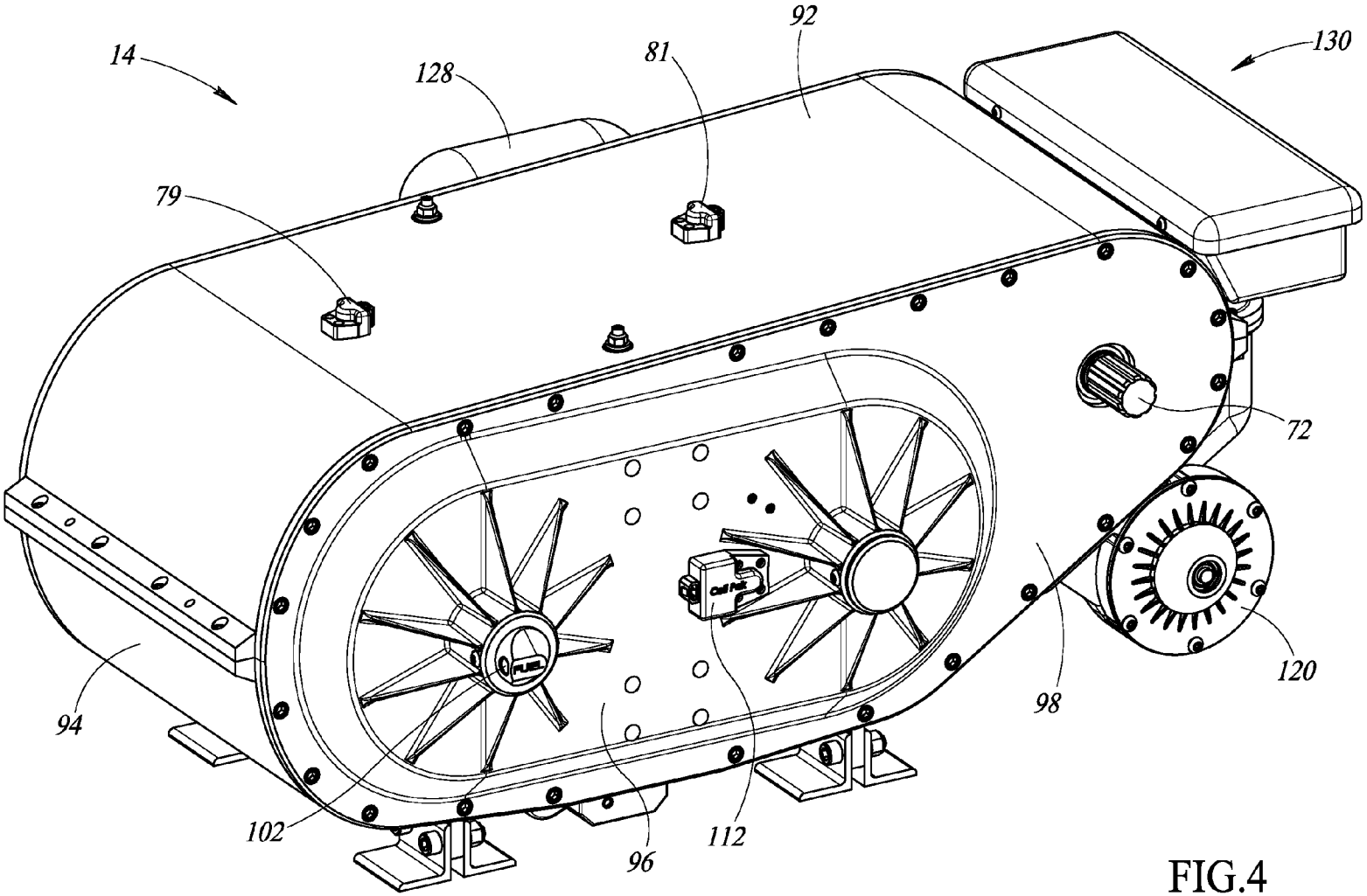
FIG. 4 is a front-right perspective view of the engine, according to one illustrated implementation.

FIG. 1 shows a piston drive wheel assembly 10 and a cylinder drive wheel assembly 12 for a combustible fluid-operated orbital engine 14. A fully assembled view of the engine 14 is shown in FIGS. 3 and 4. The cylinder drive wheel assembly 12 comprises a bank of three cylinders 16, and the piston drive wheel assembly 10 comprises a corresponding bank of three pistons 18. In other implementations, more or less cylinder/piston pairs may be included. The pistons 18 each comprise a piston head 20 coupled to a piston axle or shaft 22 (FIG. 12), and a piston body 24. The cylinders 16 each comprise a cylinder head 26 (FIG. 11) coupled to a cylinder axle or shaft 28 (FIG. 12), and a cylinder sleeve 30 configured for receiving a piston 18. Each of the pistons 18 are arranged so that they are at all times in opposed relation on a common longitudinal axis with a corresponding cylinder 16.

FIGS. 2A-2D illustrate the motion of a piston and a cylinder during operation. In this illustration, a cylinder 170 and a piston 172 are shown. The cylinder 170 and 172 are discussed further below with reference to FIGS. 16-19. Generally, the cylinder 170 and piston 172 are similar to the cylinder 16 and the piston 18 in many respects, except the sealing system for the cylinder 170 and 172 is coupled to the piston rather than the cylinder.

As shown in FIGS. 2A-2D, the cylinders 170 and pistons 172 are configured for orbital motion along intersecting counter paths 32 and 34, respectively, defined by respective cylinder and piston carrier or drive wheels 36A, 36B and 38A, 38B (see FIG. 1). The carrier wheels 36A, 36B and 38A, 38B are best shown in FIG. 1 and are operative to rotate the respective cylinders 170 and pistons 172 in a circular motion along the paths 32 and 34 shown in FIGS. 2A-2D. The carrier wheels 36A, 36B rotate around a main cylinder assembly axle or shaft 40 (FIGS. 2A-2D) and the carrier wheels 38A, 38B rotate about a main piston assembly shaft 42.

Figure 8:
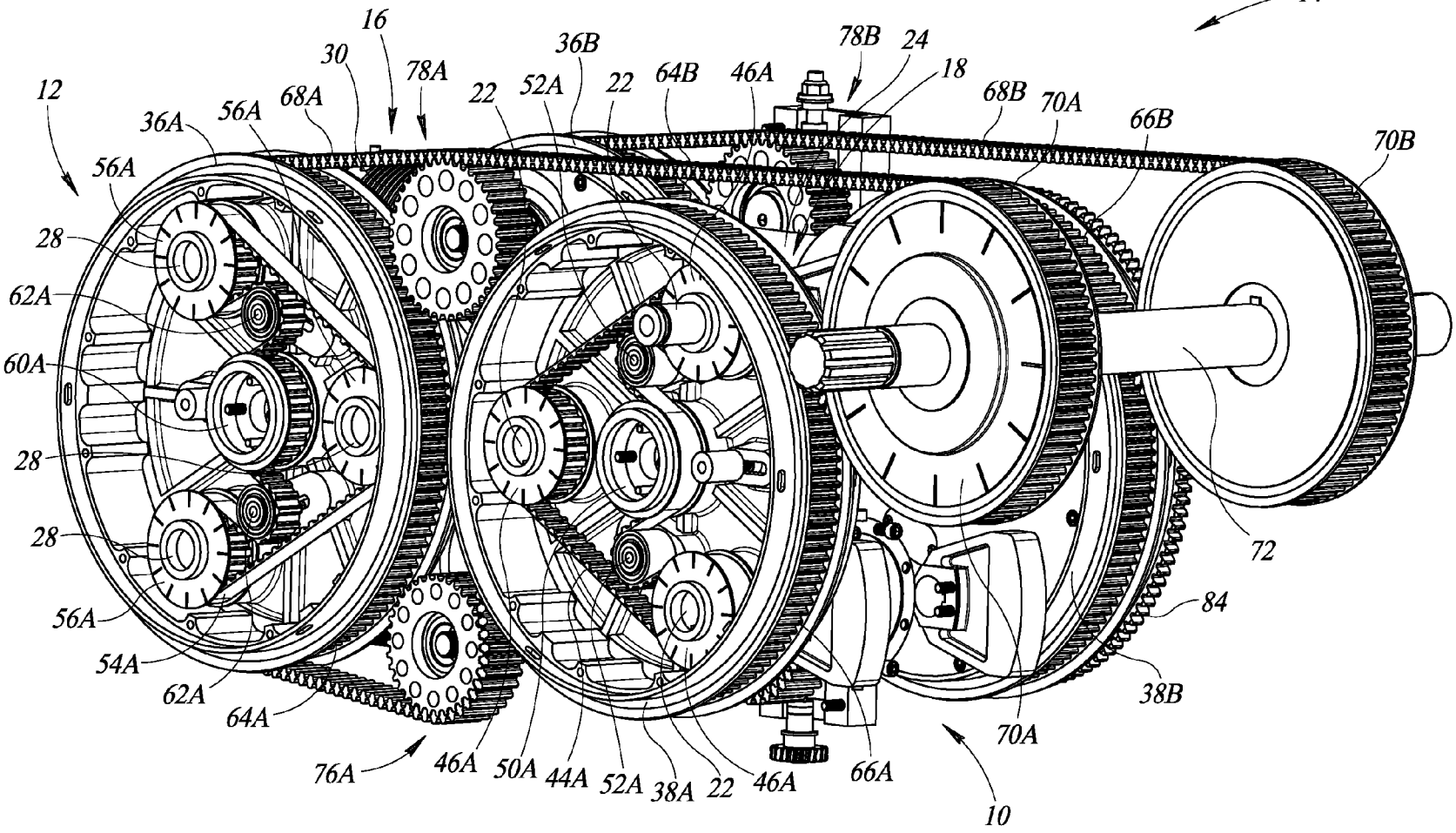
FIG. 8 is a perspective view of the cylinder drive wheel assembly and the piston drive wheel assembly of the engine with the case and other components removed, according to one illustrated implementation.

As may best be seen in FIGS. 1 and 8, the orbital motion of the pistons 18 is controlled by a piston transmission alignment belt 44A (FIG. 8) positioned around adjustable piston sprockets 46A coupled to drive shaft 42A, a fixed center sprocket 50A, and idler sprockets 52A. Such components are duplicated on each of the piston carrier wheels 38A, 38B, with components associated with the piston carrier wheel 38A designated with the letter "A" and components associated with the piston carrier wheel 38B designated with the letter "B." Similarly, the orbital motion of the cylinders 16 is controlled by a cylinder transmission alignment belt 54A positioned around adjustable cylinder sprockets 56A coupled to drive shaft 40A, a fixed center sprocket 60A, and idler sprockets 62A. Such components are duplicated on each of the cylinder carrier wheels 36A, 36B, with components associated with the cylinder carrier wheel 36A designated with the letter "A" and components associated with the cylinder carrier wheel 36B designated with the letter "B." Thus, the rotational and orbital motion of the cylinders 16 and pistons 18 may be produced using these sprockets and belts, such that the cylinder and piston carrier wheel assemblies 36A, 36B and 38A, 38B, respectively, carry the pistons/cylinders circularly and orbitally and at all times in opposed relation on a common longitudinal axis along intersecting counter paths.

The cylinder carrier wheel assemblies 36A, 36B include respective outer ring sprockets 64A, 64B, and the piston carrier wheel assemblies 38A, 38B include respective outer ring sprockets 66A, 66B. The cylinder carrier wheel assembly 36A is coupled to the piston carrier wheel assembly 38A by a first cog belt 68A, and the cylinder carrier wheel assembly 36B is coupled to the piston carrier wheel assembly 38B by a second cog belt 68B. The cog belts 68A-B are also coupled to power takeoff sprockets 70A and 70B, respectively, which are used drive a power takeoff shaft 72 coupled to a generator 74 (FIG. 1). The cog belts 68A-B may be made of any suitable materials (e.g., polyurethane, etc.). In some implementations, the cog belts may be poly-chain brand belts available from Gates Corporation, for example.

As noted above, by utilizing the belts 68A and 68B instead of gears, no oil is required and there is no backlash. Further, since there are two belts 68A and 68B, if there is a belt failure, the engine 14 will not be damaged and will continue to operate until the failed belt is replaced. Sensors (not shown) may detect any belt failure and limit the power output of the engine until the belt is replaced.

As shown in FIGS. 1, 5A-B, and 6A-B, the engine 14 may include lower tensioner slide assemblies 76A, 76B and upper tensioner slide assemblies 78A, 78B which provide belt tensioning and drive wheel alignment to insure accuracy of the piston cylinder alignment. Each of the cylinders 16 and pistons 18 may include a magnetic sender 77 which is sensed by a respective cylinder alignment sensor 79 (FIG. 3) or piston alignment sensor 81 positioned on the center top case 92. The slide assemblies 76A, 76B and 78A, 78B may be automatically controlled responsive to alignment signals detected by the cylinder alignment sensor 79 and the piston alignment sensor 81.

A starter gear 80 (FIG. 5A) is coupled to a starter assembly 82 and to a sprocket 84 on the piston carrier wheel assembly 38B (FIG. 8).

Because the cylinders and the pistons are to remain on a common longitudinal axis A-A shown in FIGS. 2A-2D, they need to be turned on their transverse axes (i.e., rotated counter to the circular direction of movement to remain aligned within their corresponding piston/cylinder throughout 360 degrees of travel as they are carried circularly by the wheels 36A, 36B, 38A, 38B). The ratio of counter rotation of the cylinders 16 and the pistons 18 relative to the circular rotation of their respective carrier wheels 36A, 36B and 38A, 38B is whatever is needed to maintain the axial alignment on the common longitudinal axis A-A. Typically, this will be 1:1 in most implementations.

The basic movement of each of the pistons 172 and cylinders 170 of the engine 14 is schematically illustrated in FIGS. 2A-2D. As shown, the piston carrier wheels 38A, 38B carry the piston 172 rotating clockwise (CW) on the circular path 34 about the piston assembly axle 42. The cylinder carrier wheels 36A, 36B carrying the cylinder 170 is shown rotating counter clockwise (CCW) on the circular path 32 about the cylinder assembly axle 40 that is parallel with the piston assembly axle 42. The path 32 intersects the path 34 as shown. The piston 172 and the cylinder 170 are in alignment as they approach each other and as they depart each other as illustrated.

To achieve the aforementioned rotational and orbital motion, the shafts 28 and 22 of each of the cylinders 16 and pistons 18, respectively, are coupled with respective sprockets (e.g., sprockets 56A and 46A shown in FIG. 8) carried by the carrier wheels 36A, 36B and 38A, 38B, respectively, which are in turn coupled to respective fixed center sprockets (e.g., sprockets 60A and 50A) via respective belts (e.g., belts 54A and 44A). This structure operates to counter-rotate the cylinders 16 and pistons 18 in a 1:1 ratio to the rotation of their respective carrier wheels 36A, 36B and 38A, 38B.

Figure 7:
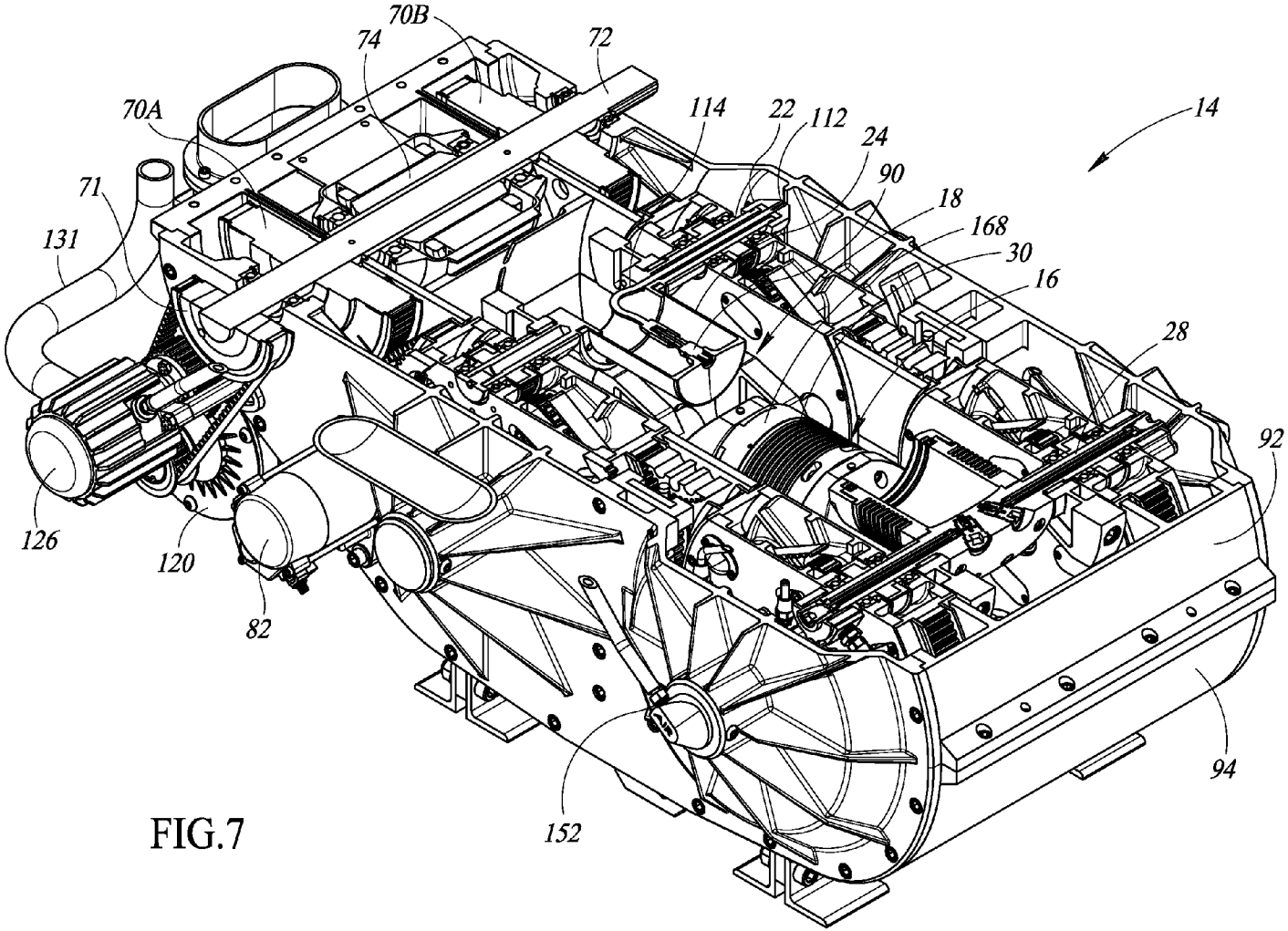
FIG. 7 is a sectional perspective view of the engine illustrating an injection air compressor, starter motor, cooling air blower and generator, according to one illustrated implementation.

As discussed in further detail below, there is a combustible fluid supply to each of the cylinders 16 for combustion coincident with the periodic interfittment of the cylinders and pistons 18. There is also an air injection supply to each of the cylinders 16 to purge the exhaust gases and supercharge the combustion gases. A combustible fluid detonator comprising a spark plug 90 (FIG. 7) is operatively associated with each of the pistons 18. During operation, the carrier wheels 36A, 36B and 38A, 38B rotate under the explosive impetus of the detonation between one cylinder/piston pair to bring the other cylinder/piston pair together, and so on, in a "circle cycle." The engine 14 is suitable for diesel operation by increasing compression and injector pressure, as well as for operation by steam, compressed gas, or other fluid (e.g., liquid, gas) energy source.

As shown in FIGS. 3, 4, 5A-B and 6A-B, the engine 14 includes a top case 92, a bottom case 94, a left side case 96, and a right side case 98. The cases 92, 94, 96, and 98 and exhaust baffle 100 form an atmosphere control chamber for the piston/cylinder pairs.

Figure 9:
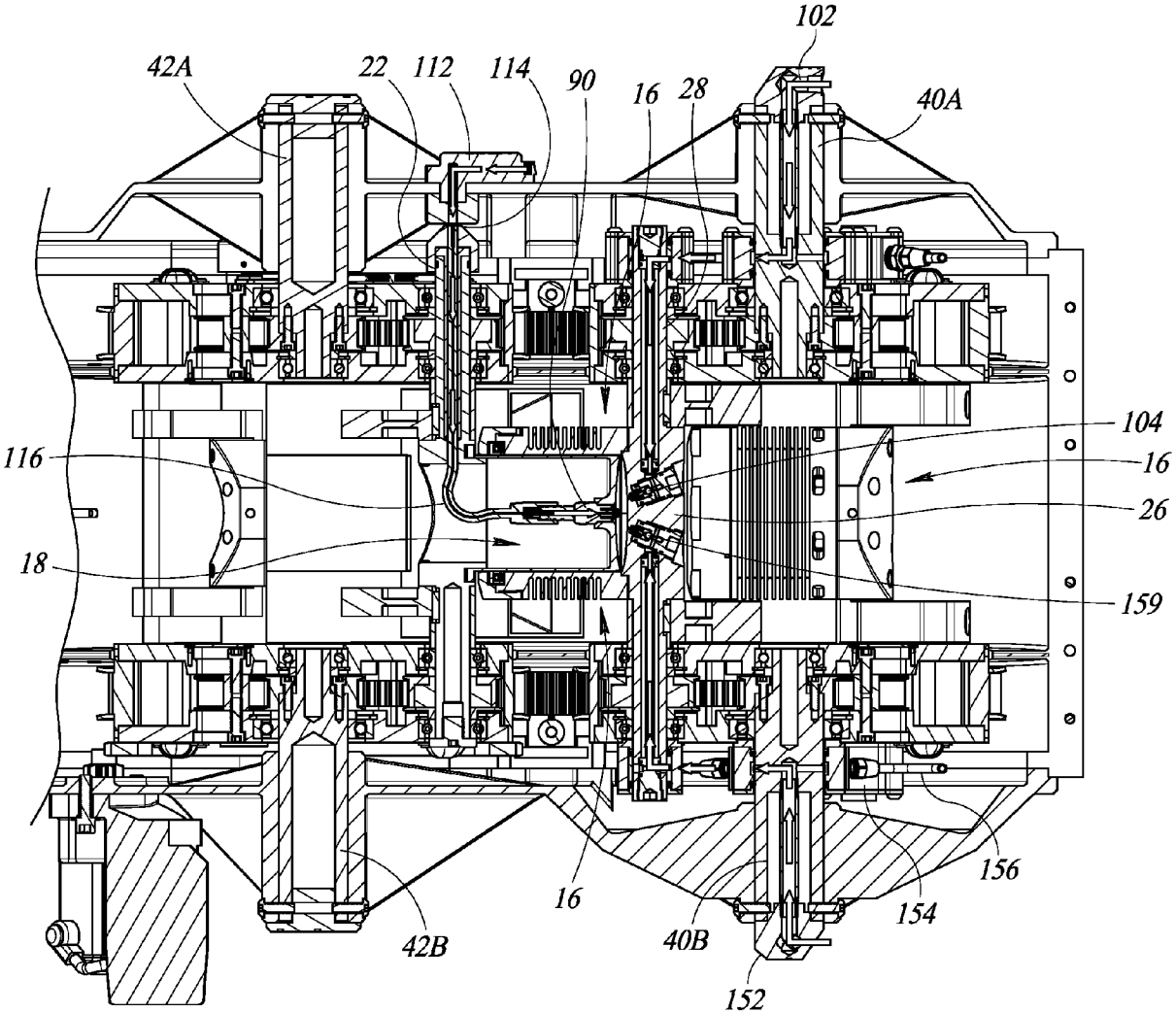
FIG. 9 is a sectional perspective view of the cylinder drive wheel assembly illustrating an air injection line, a fuel-in line, and an ignition line, according to one illustrated implementation.
Figure 11:
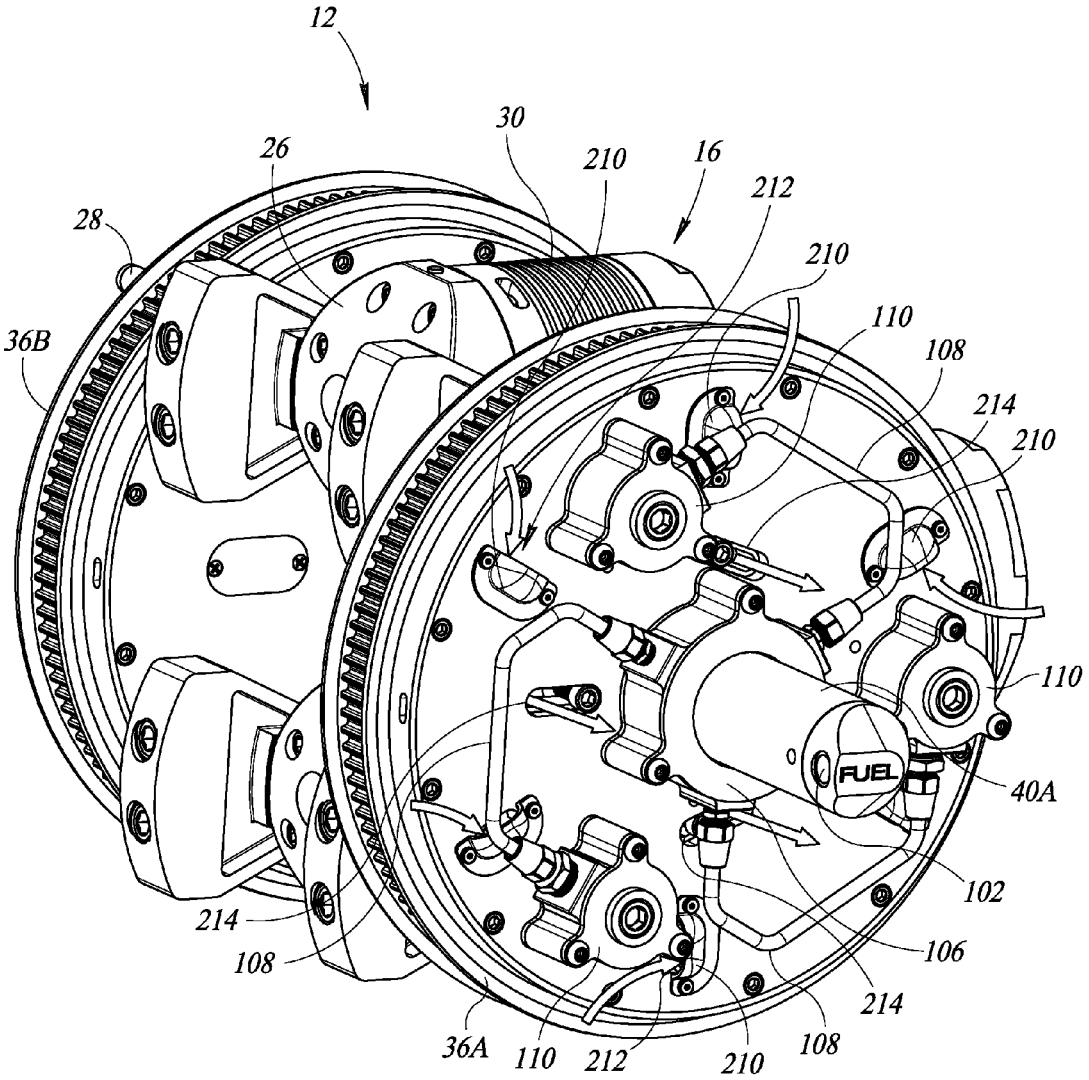
FIG. 11 is a perspective view of the cylinder drive wheel assembly illustrating transmission cooling, according to one illustrated implementation.
Figure 12:
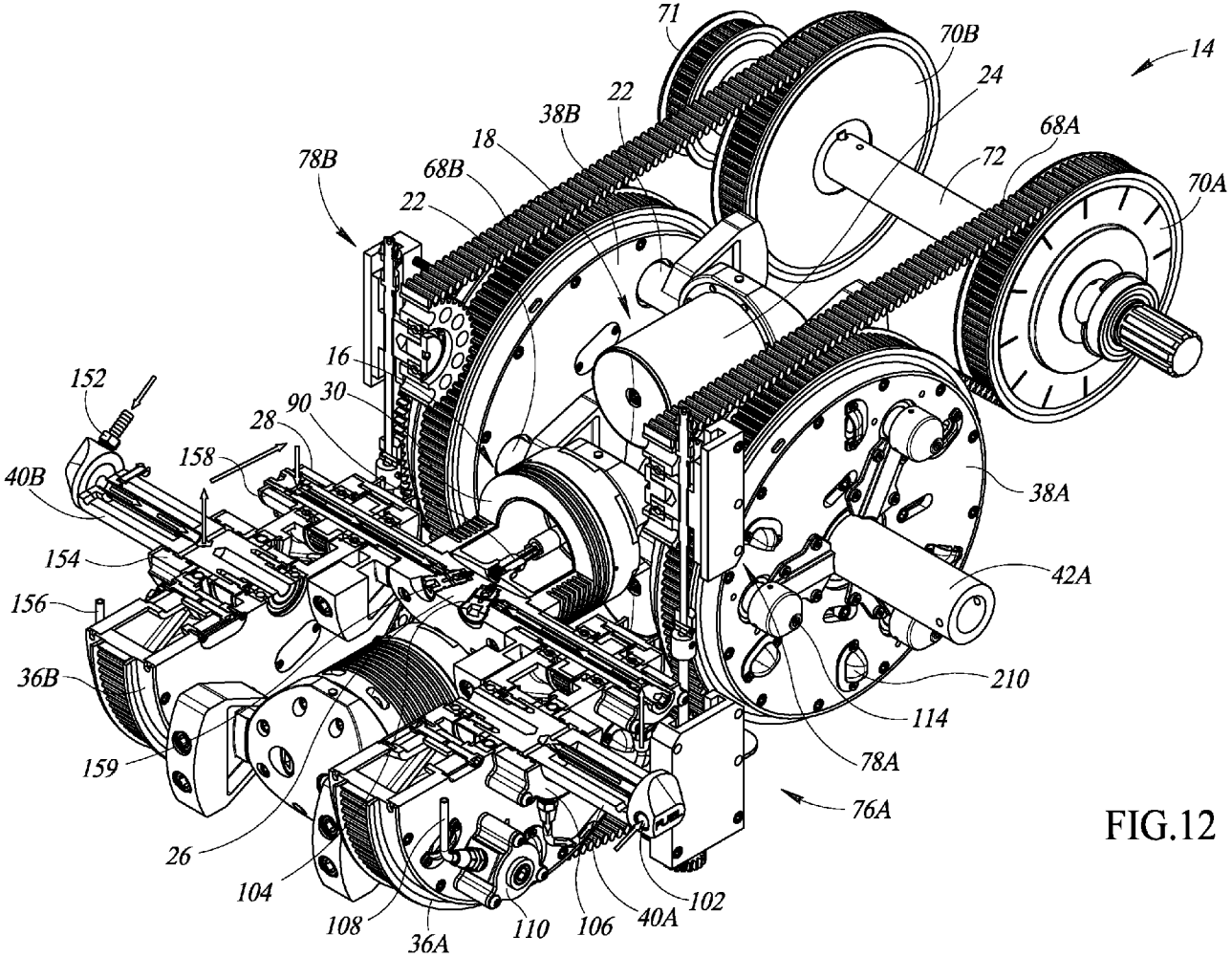
FIG. 12 is a sectional perspective view of the engine illustrating the air and fuel distribution system of the engine, according to one illustrated implementation.

Referring now to FIGS. 9, 11 and 12, fuel enters the engine 14 through a fuel-in port 102 coupled to the main cylinder assembly axle 40. The fuel is distributed to the cylinder assembly axle 40 where it is distributed by a fuel hub 106 and fuel lines 108 to rotary unions 110 which inject via a fuel injector nozzle 104 into the cylinder head 26 of each of the cylinders 16. The fuel flow may be activated by a computer control unit (CCU) through an electronic fuel control regulator (not shown) according to determined port timing (see FIG. 13).

Figure 5A:
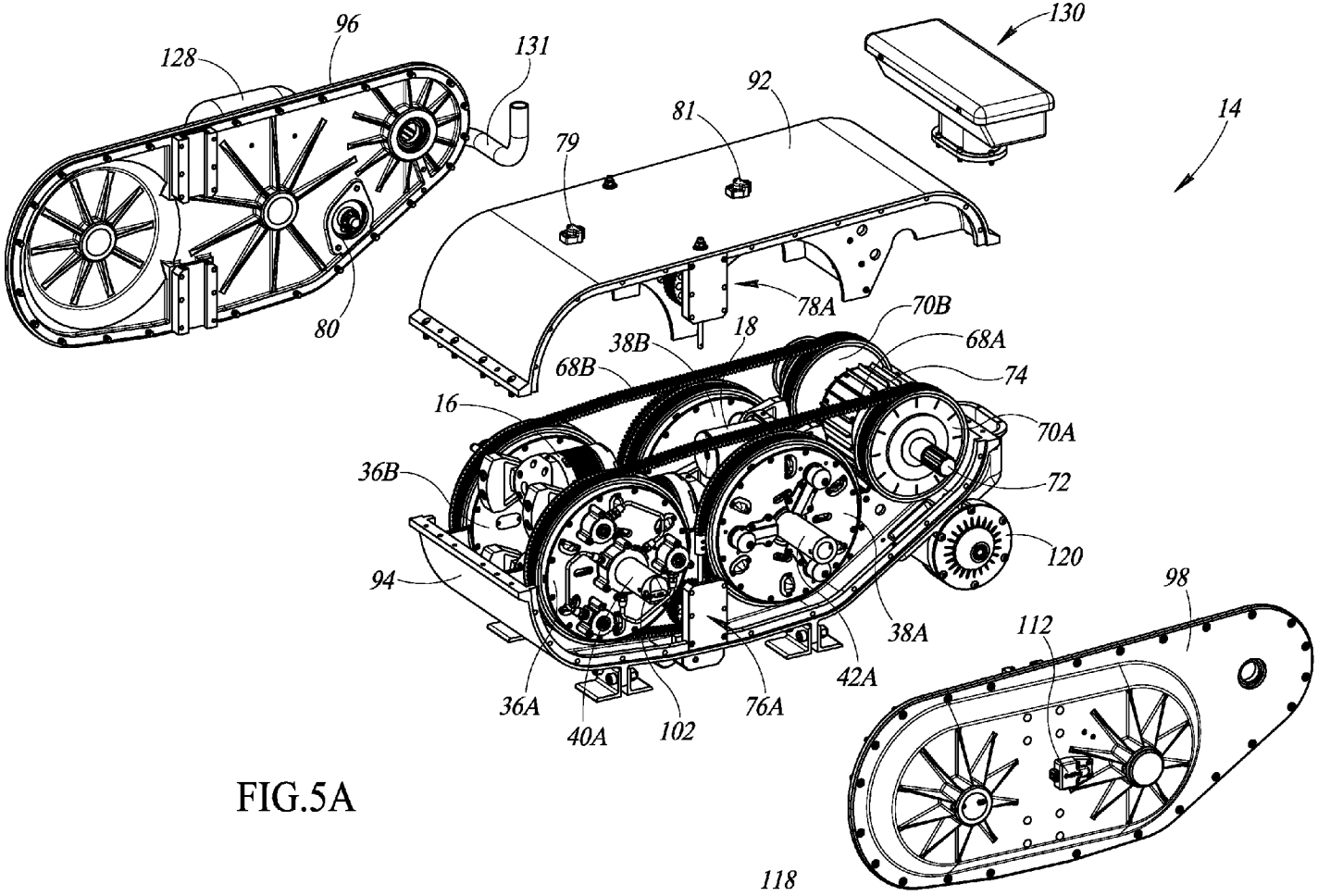
FIG. 5A is a front-right partially exploded view of the engine with a side case and its associated components removed, according to one illustrated implementation.
Figure 5B:
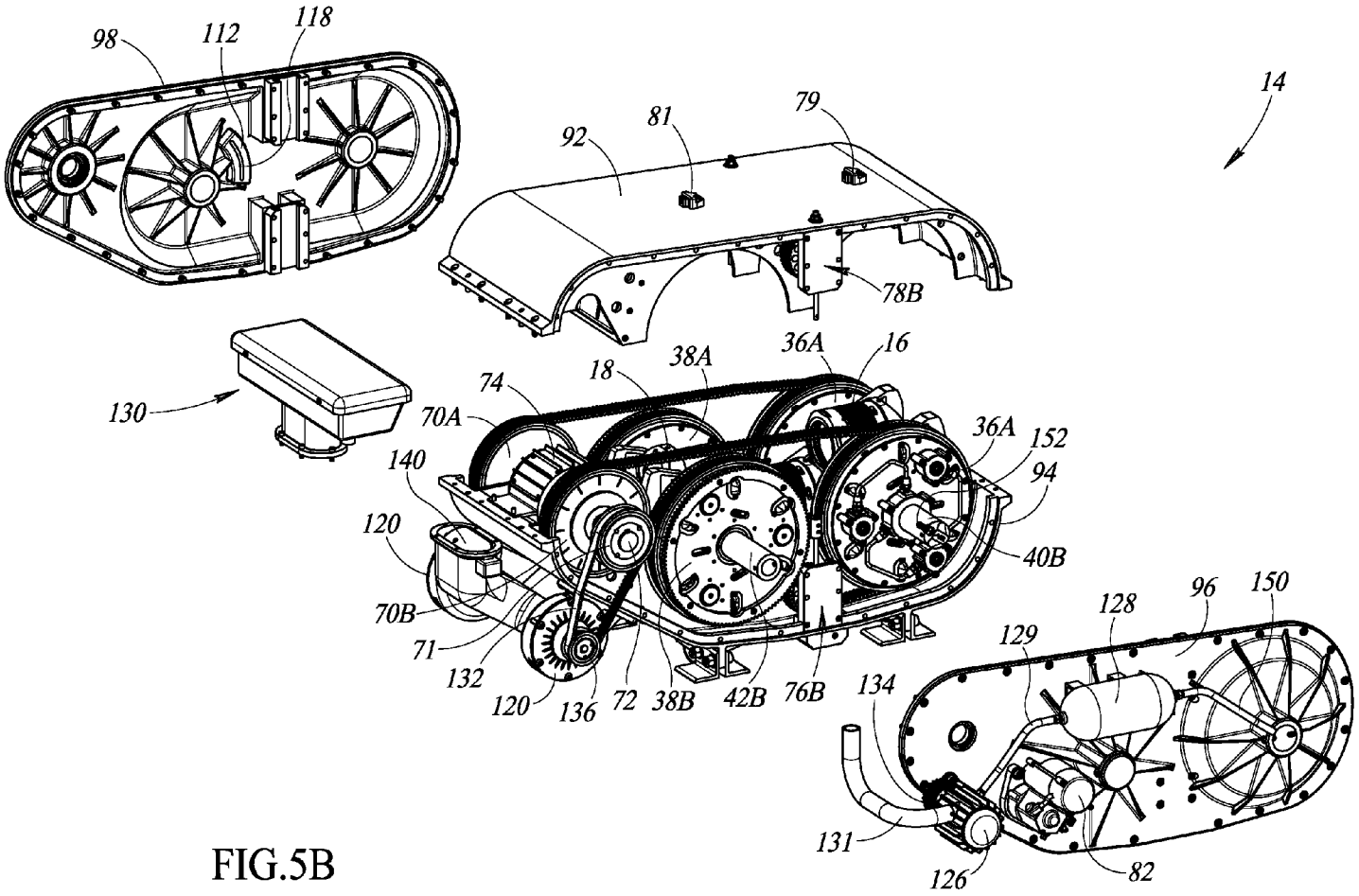
FIG. 5B is a rear-left partially exploded view of the engine with a side case and its associated components removed, according to one illustrated implementation.
Figure 6A:
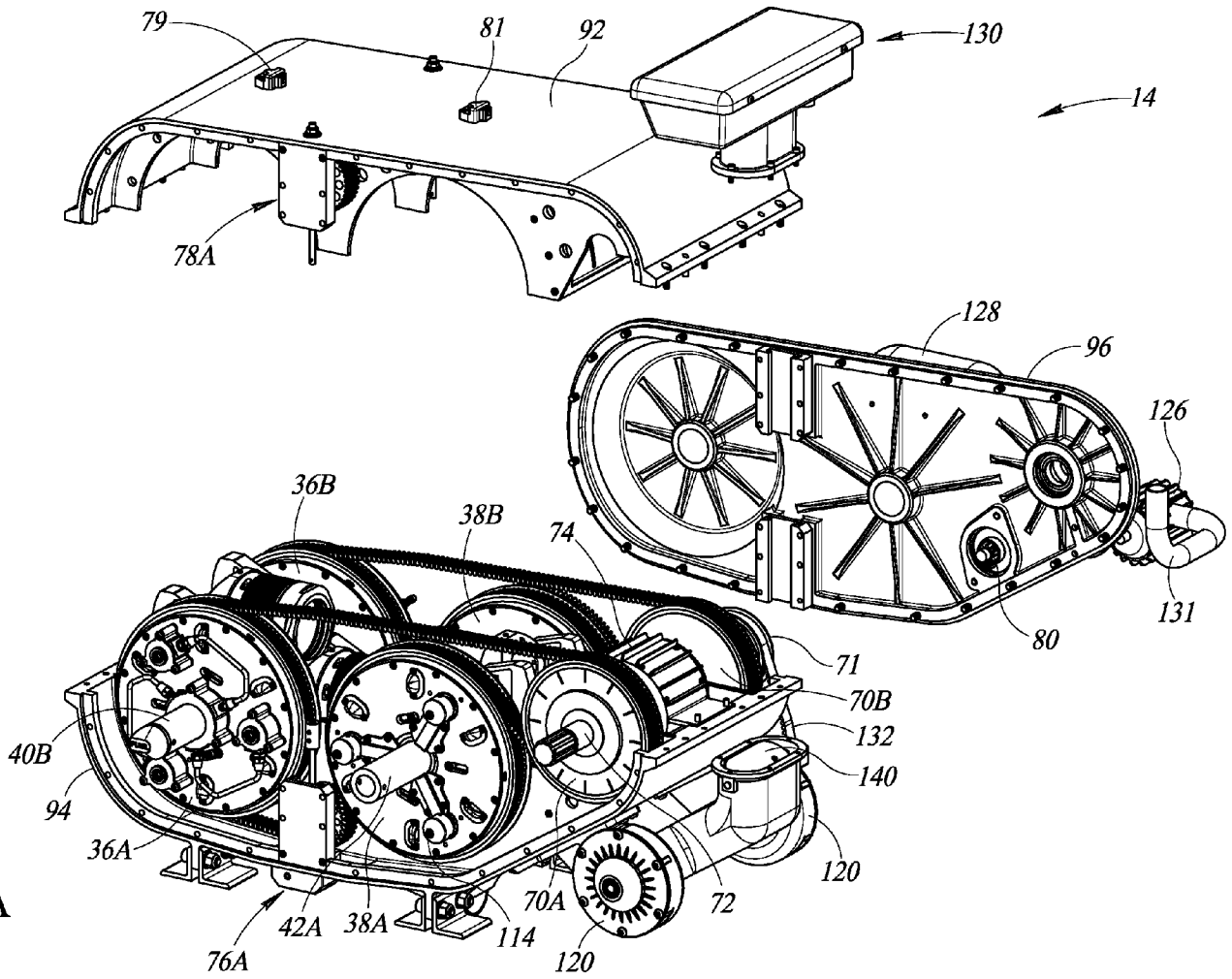
FIG. 6A is a rear-right partially exploded view of the engine with a side case and its associated components removed, according to one illustrated implementation.
Figure 6B:
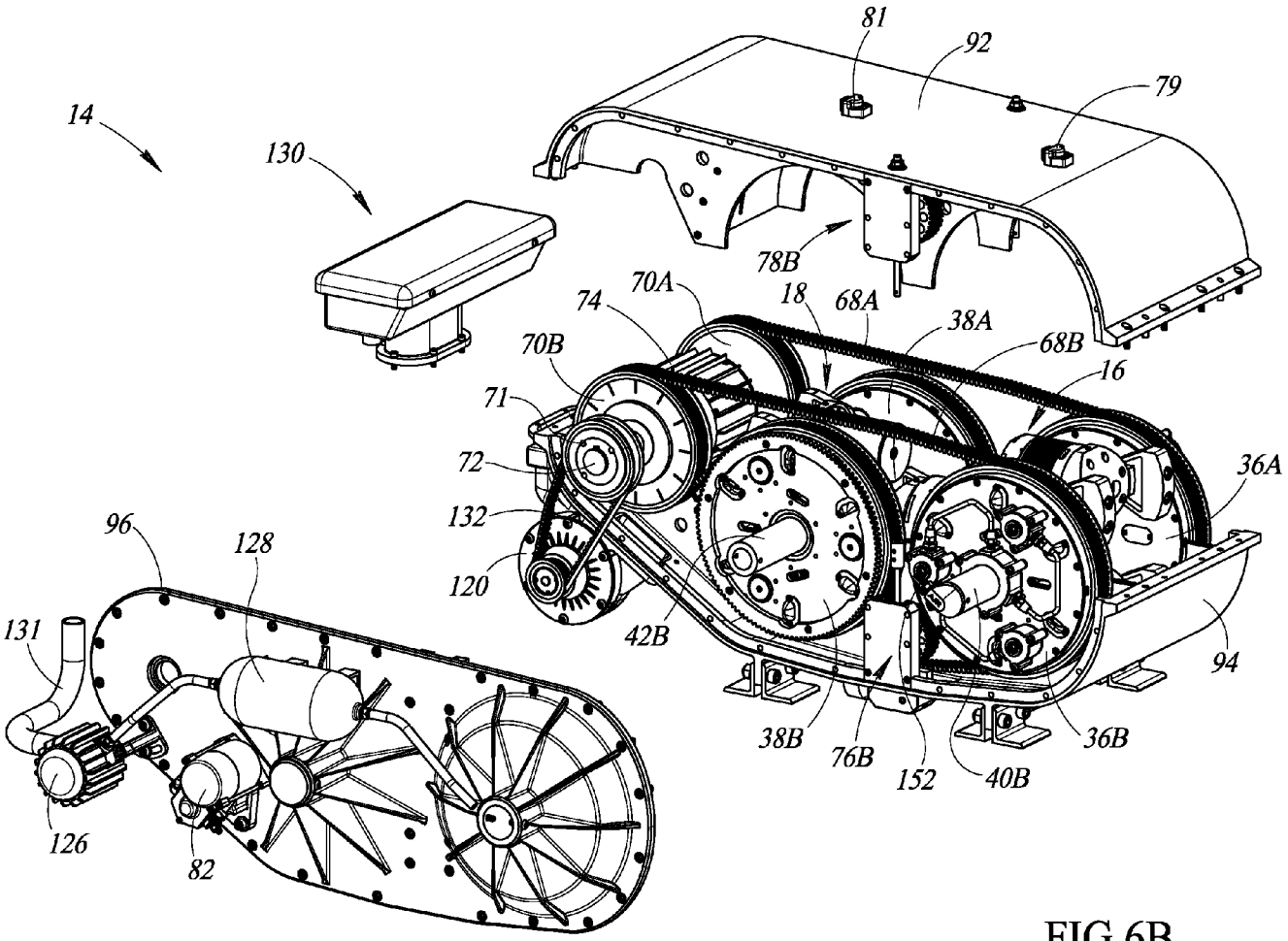
FIG. 6B is a front-left partially exploded view of the engine with a side case and its associated components removed, according to one illustrated implementation.

The ignition for the engine 14 may be controlled by an ignition distribution assembly 112, which delivers energy to the spark plug 90 via an end portion 114 of a spark plug wire 116 that extends through the piston axles 22 to an ignition commutator 118 (FIG. 5B). The spark plug wire 116 is coupled to the ignition commutator 118 which is attached to the inside surface of the left side case 98. As can be appreciated, in a diesel version of the engine 14, the ignition system is not needed since the heat of compression is used to initiate ignition to burn the fuel.

The engine 14 also comprises a breathing system that includes dual blowers 120, volutes 122, and an exhaust transition duct 124. Each of the blowers 120 may include a blower motor and blower impellers. The blowers 120 are each coupled to one of the two volutes 122, each being directed into one of the atmosphere control chambers of the engine 14 (see FIGS. 10 and 14).

The blowers 120 are coupled to a blower tensioner assembly with air pump 126 which is fluidly coupled to an air tank 128 by an air line 129 and fluidly coupled to an air cleaner assembly 130 via an air pump inlet tube 131. The air pump 126 is coupled to the power takeoff shaft 72 via a blower belt 132 which is coupled to an air pump/tensioner sprocket 134 and a power takeoff drive sprocket 71. The blowers 120 are also coupled to the power takeoff shaft 72 via a blower sprocket 136 and the blower belt 132.

In operation, the computer control unit (CCU) may control the blowers 120 and a butterfly air control flap 140 (FIG. 1). A positive pressure may be maintained in the atmosphere control chambers by regulating the speed of the blowers 120 and the air pump 126. At low engine speed, some of the exhaust gases may be re-circulated to limit the oxygen available in the combustion chambers of the cylinders 16. As the speed of the engine 14 increases, the butterfly air control flap 140 may be opened. Engine cooling may be controlled by increasing the output of the blowers 120 as needed.

The air tank 128 delivers air via an air line 150 to an air-in port 152 coupled to the main cylinder assembly axle 40 on the right side thereof. The air is distributed to the cylinder assembly axle 40 where it is distributed by an air hub 154 and air lines 156 to rotary unions 158 which inject via an air injector nozzle 159 into the center of the cylinder head 26 of each of the cylinders 16. The air flow may be activated by a computer control unit (CCU) through an electronic air control regulator (not shown) according to determined port timing (see FIG. 13).

Figure 15:
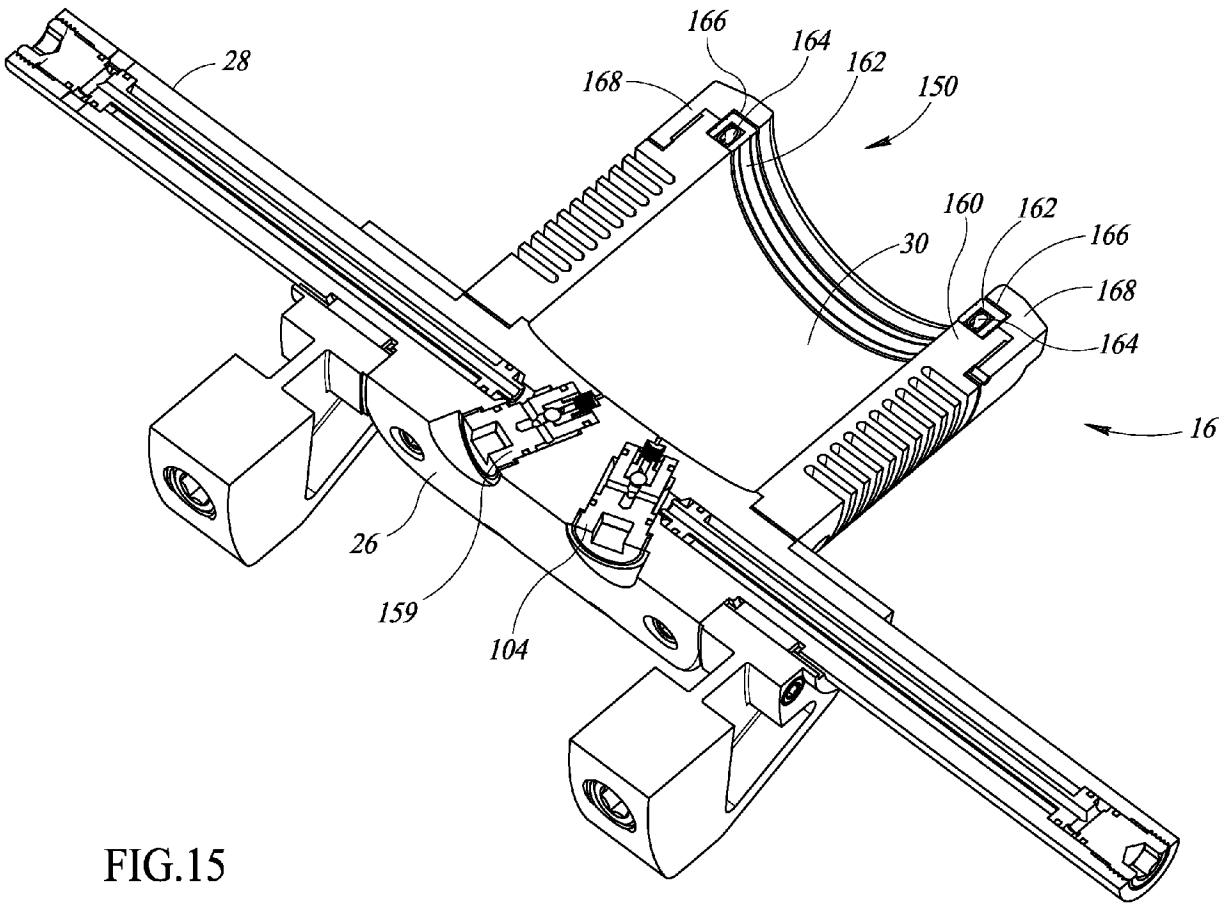
FIG. 15 is a sectional perspective view of a cylinder assembly of the engine, according to one illustrated implementation.

Referring now to FIG. 15, unlike other piston/cylinder operating systems, in some implementations the engine 14 has a sealing system located in an entry portion 160 of each cylinder 16 rather than connected to the piston 18. Because the piston 18 does not come into contact with the cylinder 16, lubrication of the walls of the cylinder is not required. The sealing system includes a non-metallic flexible seal 162 (e.g., PTFE (25% glass fiber fill)) and a seal energizer 164 which are positioned within an annular recess 166 in the entry portion 160 of the cylinder 16. The seal 162 and seal energizer 164 are retained in the recess 166 at the entry portion 160 of the cylinder 16 by a selectively removable cylinder ring cap 168.

The seal 162 is designed to withstand the heat and pressure of the combustion process. The seal 162 has very little compression leakage, and there is little wear on the piston 18 as there is no contact between the cylinder 16 and piston 18, further improving efficiency. The seal 162 has a long life span and can be replaced as easy as changing spark plugs, if required.

Figure 16:
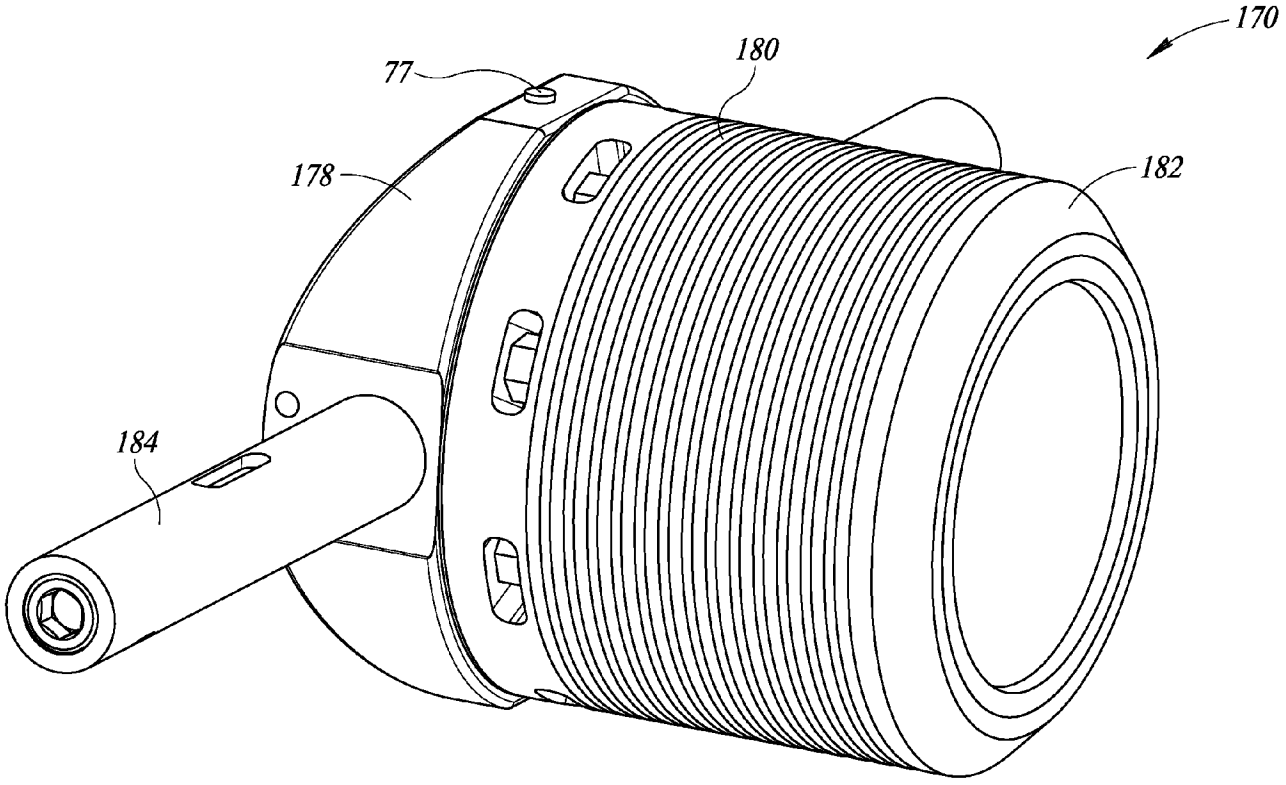
FIG. 16 is a perspective view of a cylinder assembly, according to one illustrated implementation.

According to another implementation shown in FIGS. 16-19, the engine 14 includes cylinders 170 (FIG. 16) and pistons 172 (FIGS. 17-18) which include a sealing system wherein a seal 174 is positioned proximate an end portion 176 of the piston rather than the cylinders. In particular, FIG. 16 shows a cylinder 170 which includes a cylinder head 178, a cylinder body or sleeve 180, an open end portion 182 which receives the piston 172, and a cylinder shaft or axle 184.

Figure 17:
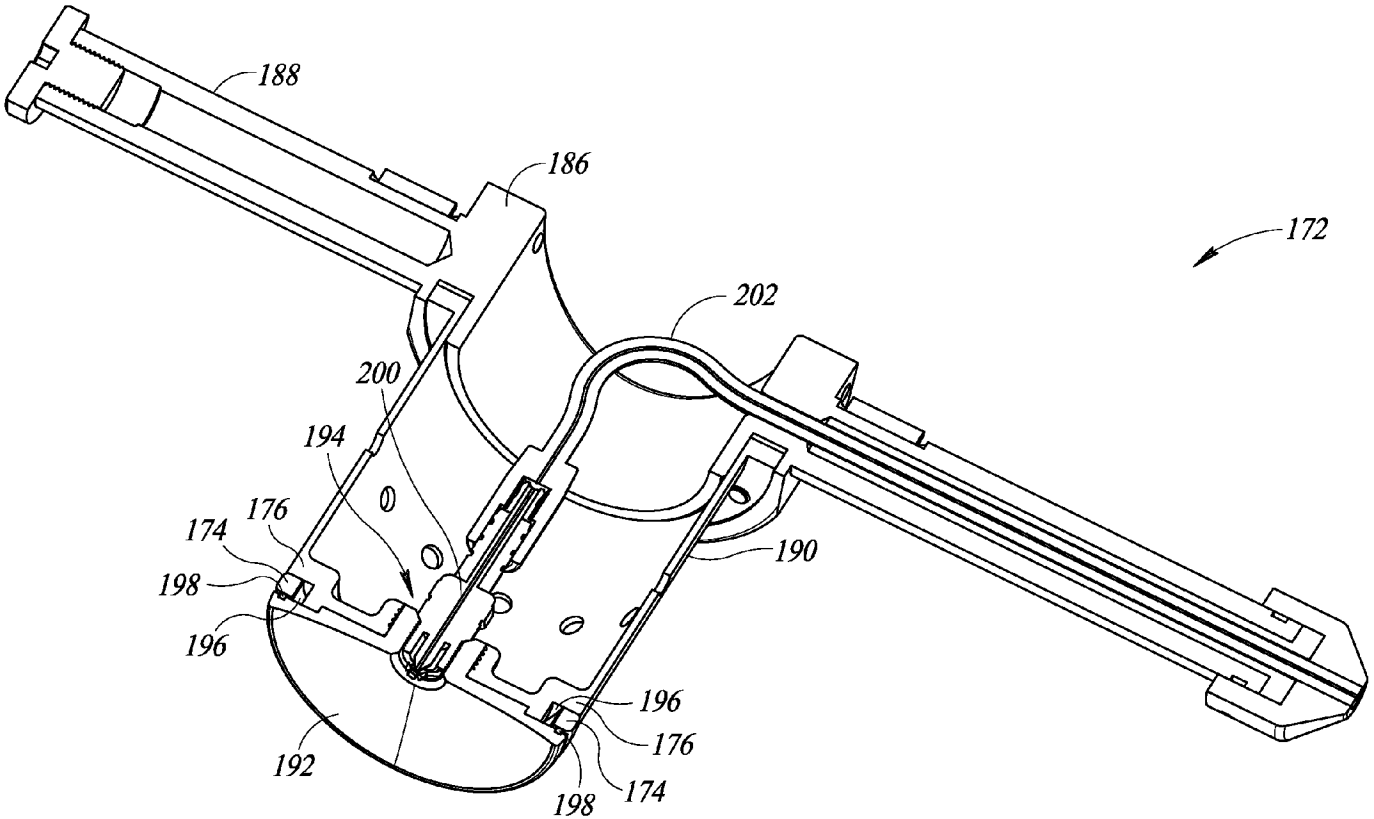
FIG. 17 is a sectional perspective view of a piston assembly, according to one illustrated implementation.
Figure 18:
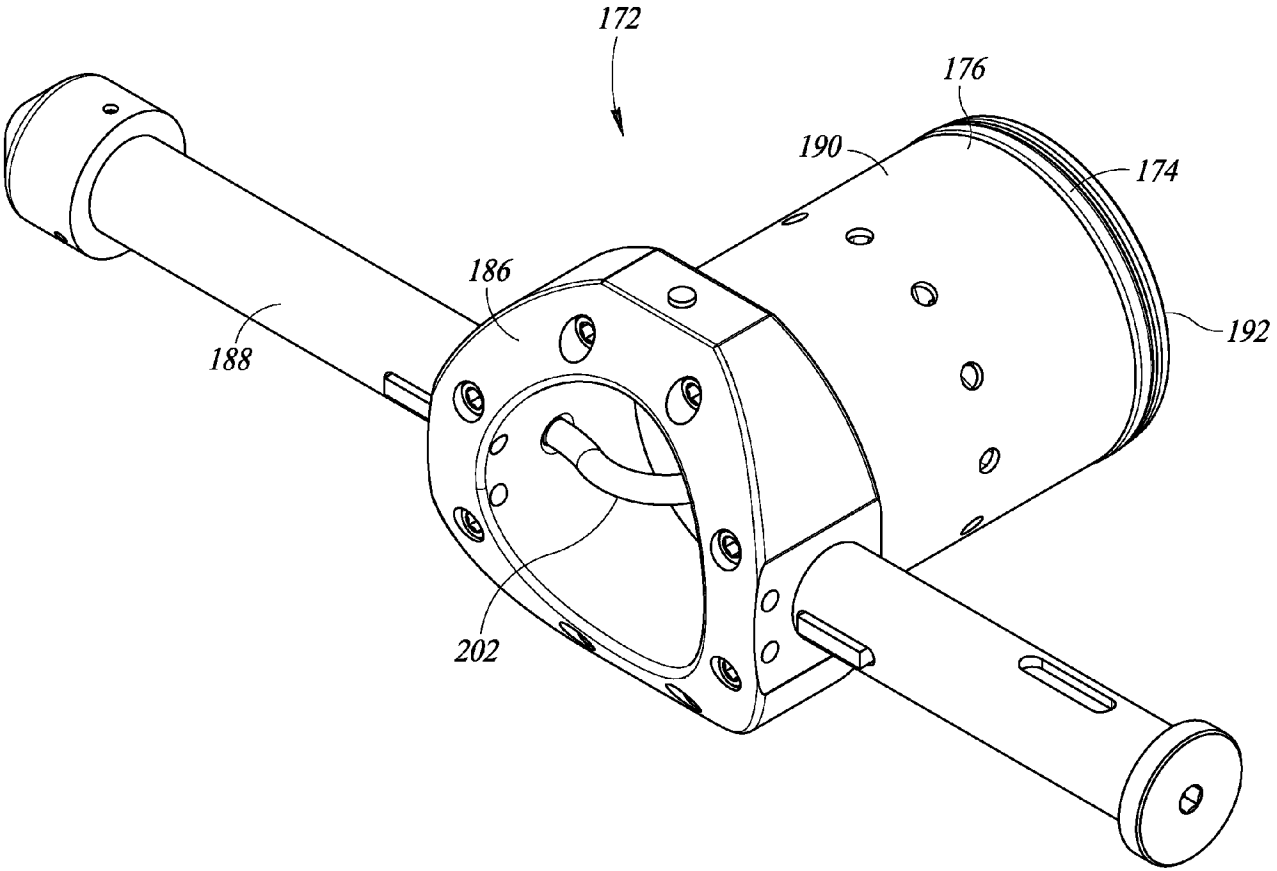
FIG. 18 is a rear perspective view of the cylinder assembly of FIG. 17, according to one illustrated implementation.
Figure 19:
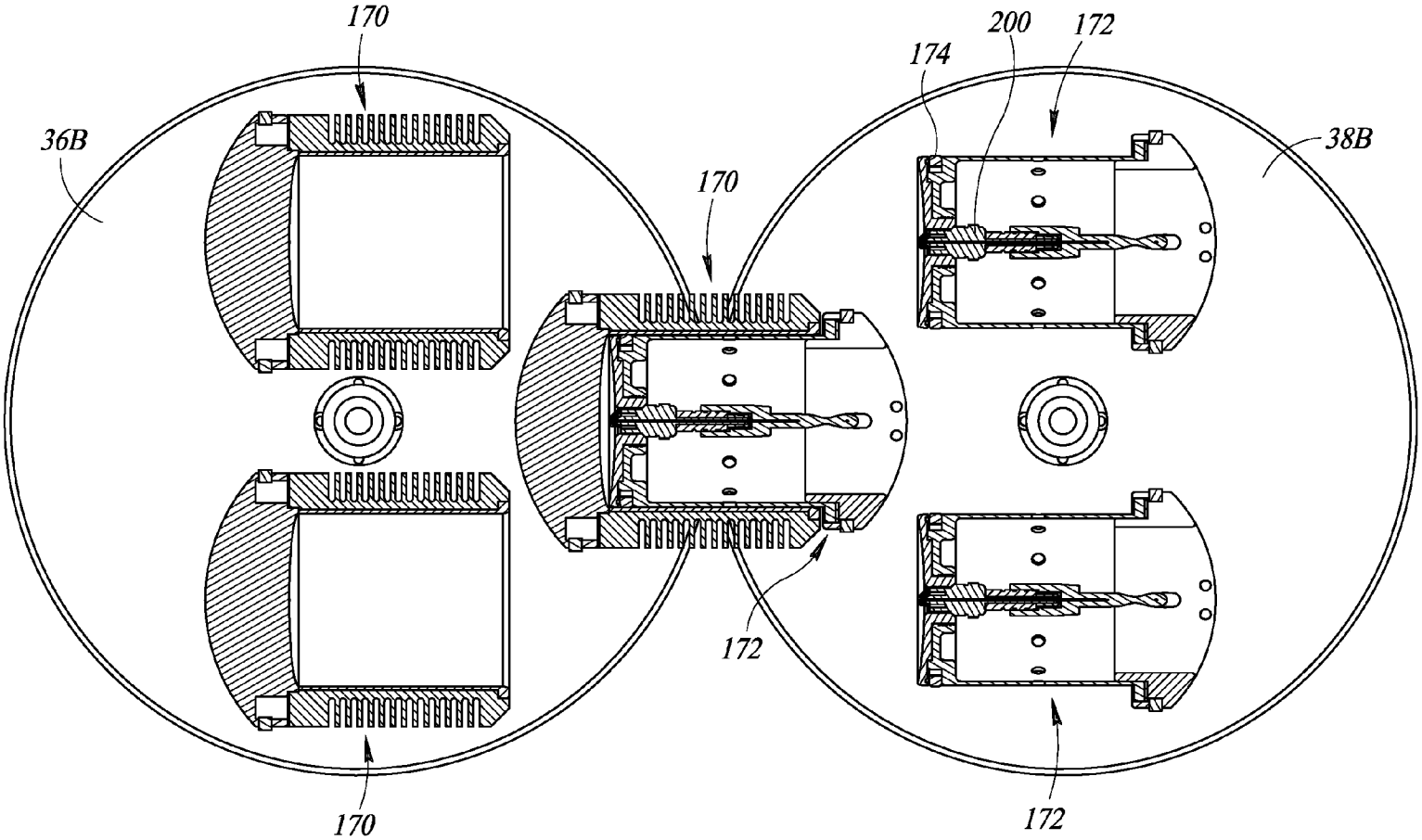
FIG. 19 is a side elevational view of a cylinder drive wheel assembly and a piston drive wheel assembly of the engine, according to one illustrated implementation.

FIG. 17 shows the piston 172 which includes a piston head 186, a piston shaft 188, a piston body 190, and a piston body nose 192. The piston body nose 192 may be selectively threadably engaged with a threaded aperture 194 in the end portion 176 of the piston body 190. When the piston body nose 192 is coupled to the end portion 176 of the piston body 190, an aperture is formed which contains the piston seal 174 and a spring energizer 196. An o-ring seal 198 is also positioned around a perimeter of the piston body nose 192 facing the piston body 190. Similar to the piston 18 described above, the piston 172 includes a spark plug 200 coupled to a spark plug wire 202, which may be selectively electrically coupled to an ignition system, as discussed above. As discussed above, spark plugs are not employed for diesel operation. Advantageously, by placing the compression seal 174 on the piston 172 rather than the cylinder 170, less heat may be transferred to the piston during operation of the engine.

In some implementations, the cylinders and/or pistons may be made from a ceramic material. Because the pistons are not in contact with the cylinder walls and because both the cylinders and the pistons are allowed to "breath" independently after each power stroke, a transfer of heat between them is not required. This allows the use of low thermal conducting ceramics to convert more of the combustion heat energy into mechanical energy, greatly increasing the thermal efficiency of the engine.

Referring now to FIG. 11, the cylinder carrier wheel assemblies 36A, 36B may include a plurality of air scoops 210 positioned around corresponding input apertures 212. During operation, the air scoops 210 channel air through the input apertures 212 into an interior chamber of the cylinder carrier wheel assemblies 36A, 36B. The air exits the cylinder carrier wheel assemblies 36A, 36B through output apertures 214. The piston carrier wheel assemblies 36A, 36B include similar or identical air scoops, input apertures, and output apertures. The input apertures, output apertures, and air scoops provide cooling for the respective cylinder carrier wheel assemblies 36A, 36B and piston carrier wheel assemblies 38A, 38B.

Figure 10:
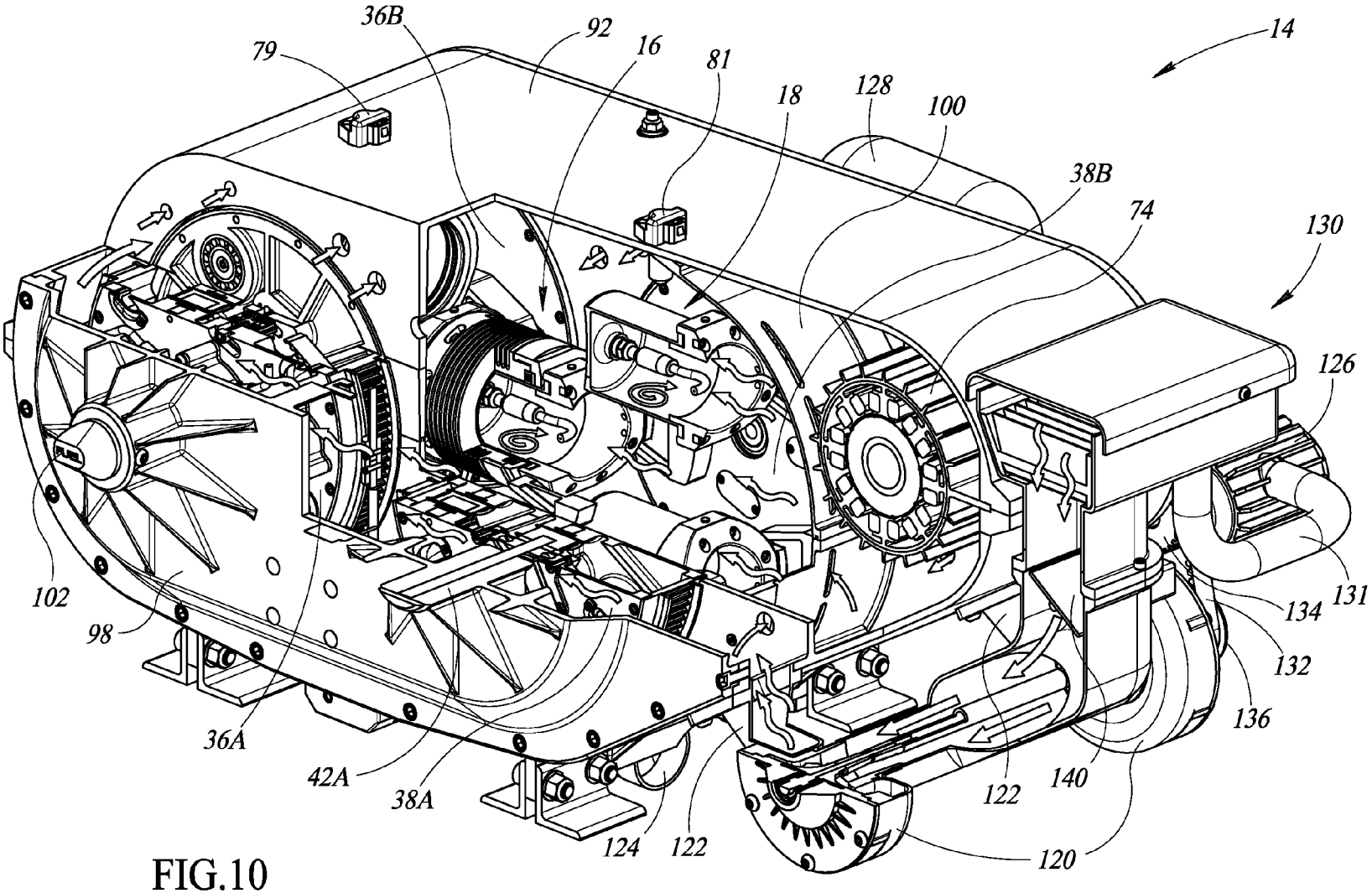
FIG. 10 is sectional perspective view of the engine illustrating engine cooling, according to one illustrated implementation.
Figure 14:
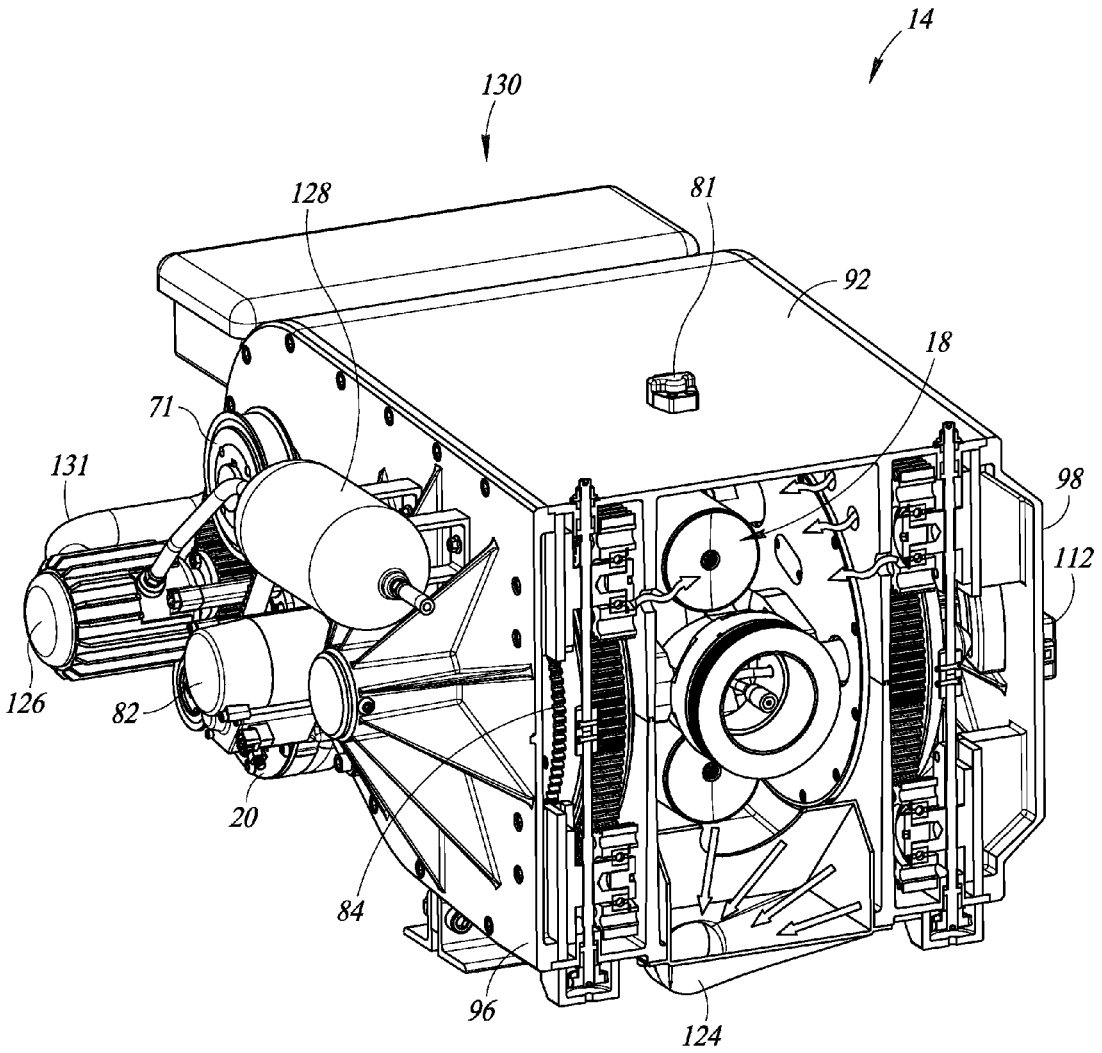
FIG. 14 is a sectional perspective view of the engine illustrating the exhaust and air cooling of the engine, according to one illustrated implementation.

FIG. 10 shows numerous arrows which indicate air flow through various components of the engine 14 during operation of the engine, which provides cooling for the engine. FIG. 14 shows a plurality of arrows which indicate air flow for the exhaust and cooling during operation of the engine 14.

Figure 13:
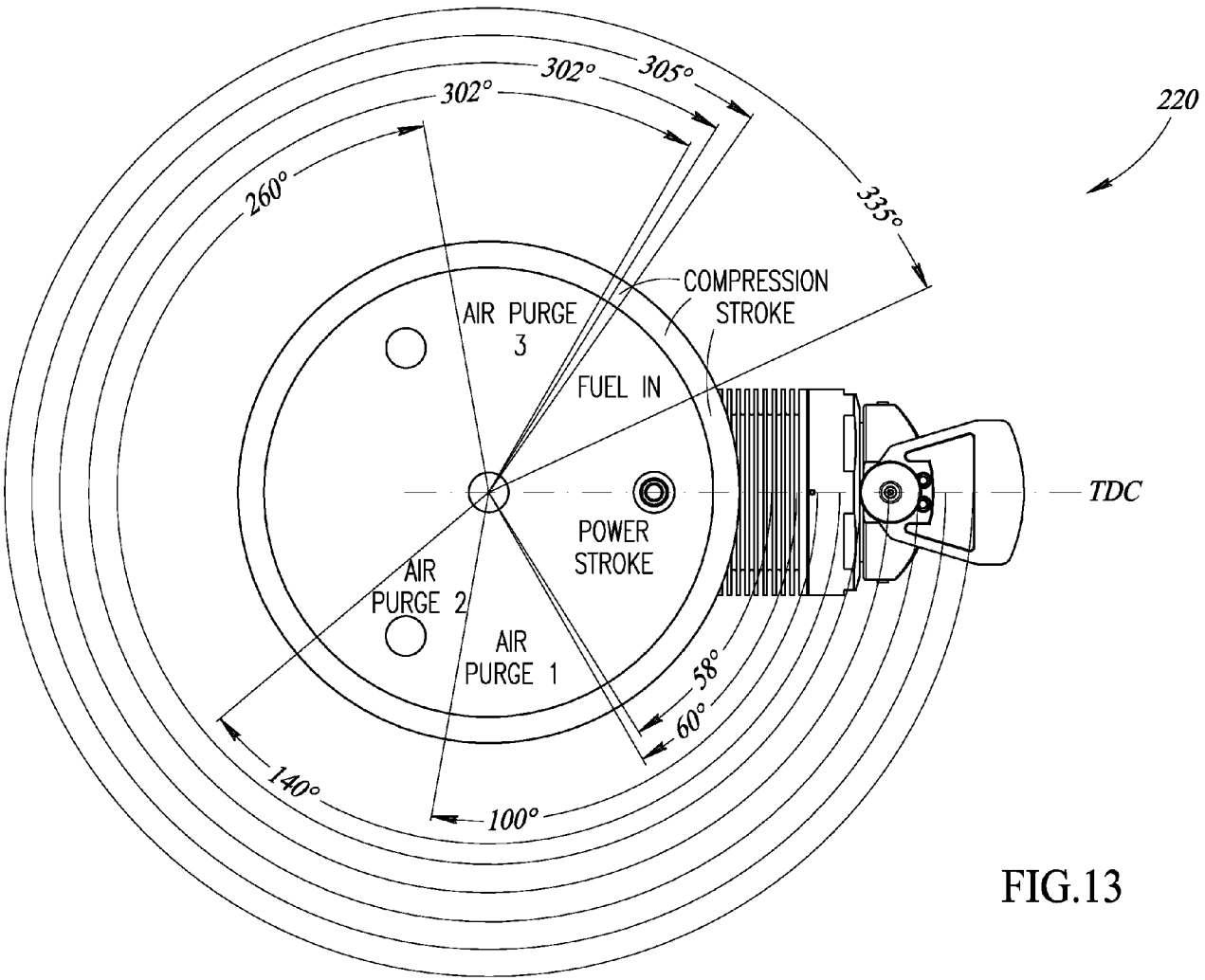
FIG. 13 is a schematic diagram illustrating the port timing for the air and fuel distribution system of the engine, according to one illustrated implementation.

FIG. 13 shows a diagram 220 for example port timing of the air and fuel distribution system of the engine 14. As noted above, the timing of the air and fuel distribution to the cylinders 16 may be controlled by suitable air and fuel regulators. The diagram 220 shows the port timing with reference to clockwise rotation. As shown, top dead center (TDC) is at 0 degrees. The power stroke is from 0-58 degrees. A first air purge phase occurs from 60-100 degrees, and a second air purge phase occurs from 100-140 degrees. An air supercharge phase ("air purge 3") occurs from 260-300 degrees, prior to the compression stroke which occurs from 302-360 degrees. Fuel is injected between 305-335 degrees. It should be appreciated that the port timing shown in the diagram 220 of FIG. 13 is provided for purposes of explanation and is not intended to be limiting.

The foregoing detailed description has set forth various implementations of the devices and/or processes via the use of block diagrams, schematics, and examples. Insofar as such block diagrams, schematics, and examples contain one or more functions and/or operations, it will be understood by those skilled in the art that each function and/or operation within such block diagrams or examples can be implemented, individually and/or collectively, by a wide range of hardware, software, firmware, or virtually any combination thereof. Those of skill in the art will recognize that many of the methods or algorithms set out herein may employ additional acts, may omit some acts, and/or may execute acts in a different order than specified.

The various implementations described above can be combined to provide further implementations. To the extent that they are not inconsistent with the specific teachings and definitions herein, all of the U.S. patents, U.S. patent application publications, U.S. patent applications, foreign patents, foreign patent applications and non-patent publications referred to in this specification and/or listed in the Application Data Sheet, including but not limited to U.S. Provisional Patent Application No. 60/792,603 filed Apr. 17, 2006, U.S. Provisional Patent Application No. 61/100,751 filed Sep. 28, 2008, U.S. Pat. No. 7,721,687, U.S. Pat. No. 8,161,924 and U.S. Pat. No. 8,555,830 are incorporated herein by reference, in their entirety. Aspects of the implementations can be modified, if necessary, to employ systems and concepts of the various patents, applications and publications to provide yet further implementations.

These and other changes can be made to the implementations in light of the above-detailed description. In general, in the following claims, the terms used should not be construed to limit the claims to the specific implementations disclosed in the specification and the claims, but should be construed to include all possible implementations along with the full scope of equivalents to which such claims are entitled. Accordingly, the claims are not limited by the disclosure.

The invention claimed is:

1. A combustible fluid-operated orbital engine, comprising:

one or more cylinders in which each cylinder has a longitudinal axis and is carried on a pair of rotating cylinder carrier wheels for orbital motion, the one or more cylinders are capable of receiving a combustible fluid therein, the pair of rotating cylinder carrier wheels being rotatable about an axle along an first axis of rotation;

one or more corresponding pistons carried on a pair of counter-rotating piston carrier wheels for opposite orbital motion, the pair of counter-rotating piston carrier wheels being rotatable about an axle along a second axis of rotation parallel to the first axis of rotation, each of the one or more pistons having a cooperating cylinder and having throughout its movement the same longitudinal axis as its cooperating cylinder to oppose and sequentially enter and completely withdraw from its cooperating cylinder on the same longitudinal axis;

a first belt which mechanically links a first one of the pair of rotating cylinder carrier wheels to a first one of the pair of counter-rotating piston carrier wheels such that the first one of the pair of rotating cylinder carrier wheels rotates in a first direction when the first one of the pair of counter-rotating piston carrier wheels rotates in a second direction opposite the first direction; and a second belt which mechanically links a second one of the pair of rotating cylinder carrier wheels to a second one of the pair of counter-rotating piston carrier wheels such that the second one of the pair of rotating cylinder carrier wheels rotates in the first direction when the second one of the pair of counter-rotating piston carrier wheels rotates in the second direction opposite the first direction.

2. The combustible fluid-operated orbital engine of claim 1, wherein each of the first belt and the second belt comprises cog belts.

3. The combustible fluid-operated orbital engine of claim 1, further comprising respective sprocket and belt assemblies supported by each of the cylinder carrier wheels and piston carrier wheels and operative to rotate the one or more cylinders and the one or more pistons counter to their circular motion direction to maintain their opposed relation for periodic interfittment when their respective paths intersect.

4. The combustible fluid-operated orbital engine of claim 1, further comprising:

a combustible fluid supply that is capable of supplying the combustible fluid to the one or more cylinders in timed relation with piston entry into the cylinder for compression, detonation, and exhaust.

5. The combustible fluid-operated orbital engine of claim 4, wherein the one or more cylinders each comprise a cylinder head coupled to a cylinder axle, the cylinder axle including a fuel tube for delivering fuel to a fuel injector nozzle operatively coupled to the cylinder.

6. The combustible fluid-operated orbital engine of claim 1, further comprising an air supply to the one or more cylinders in timed relation with piston entry into the cylinder for at least one of purging exhaust gases or supercharging combustion gases.

7. The combustible fluid-operated orbital engine of claim 6, wherein the one or more cylinders each comprise a cylinder head coupled to a cylinder axle, the cylinder axle including an air tube for delivering air to an air injector nozzle operatively coupled to the cylinder.

8. The combustible fluid-operated orbital engine of claim 1, further comprising a combustible fluid detonator operatively coupled to each piston.

9. The combustible fluid-operated orbital engine of claim 1, further comprising a blower assembly which controls at least one of pressure, air quality, or cooling of the one or more pistons and the one or more cylinders during operation of the combustible fluid-operated orbital engine.

10. The combustible fluid-operated orbital engine of claim 1, wherein each of the one or more cylinders comprises a sealing system located proximate an entry of the cylinder, the sealing system comprising a non-metallic flexible seal.

11. The combustible fluid-operated orbital engine of claim 10, wherein, for each cylinder, the non-metallic flexible seal comprises polytetrafluoroethylene.

12. The combustible fluid-operated orbital engine of claim 10 wherein, for each cylinder, the non-metallic flexible seal comprises polytetrafluoroethylene filled with a percentage of glass.

13. The combustible fluid-operated orbital engine of claim 1, wherein each of the one or more pistons comprises a sealing system located proximate an end portion of the piston, the sealing system comprising a non-metallic flexible seal.

14. The combustible fluid-operated orbital engine of claim 1, further comprising a sealing system coupled to one of: each of the one or more cylinders or each of the one or pistons, the sealing system comprising a non-metallic flexible seal and a seal energizer.

15. The combustible fluid-operated orbital engine of claim 1, wherein the one or more cylinders comprises a plurality of cylinders and the one or more pistons comprises a plurality of pistons, and wherein the longitudinal axis of each piston-cylinder pair is at all times parallel to the respective longitudinal axes of each other cooperating cylinder and piston pairs.

16. A method of operating a combustible fluid-operated orbital engine, comprising:

disposing plural sets of cooperating cylinder and piston members having respective parallel axes of rotation at all times in opposed relation on a common longitudinal axis;

supporting the cylinder members on a pair of cylinder carrier wheels;

supporting the piston members on a pair of piston carrier wheels;

mechanically linking a first one of the pair of cylinder carrier wheels to a first one of the pair of piston carrier wheels by a first belt such that the first one of the pair of cylinder carrier wheels rotates in a first direction when the first one of the pair of piston carrier wheels rotates in a second direction opposite the first direction;

mechanically linking a second one of the pair of cylinder carrier wheels to a second one of the pair of piston carrier wheels by a second belt such that the second one of the pair of rotating cylinder carrier wheels rotates in the first direction when the second one of the pair of counter-rotating piston carrier wheels rotates in the second direction opposite the first direction;

rotating the pair of cylinder carrier wheels and the pair of piston carrier wheels circularly along intersecting counter paths about axes of rotation parallel to the members' axes of rotation while simultaneously rotating the members counter to their circular motion in orbital relation sufficiently to maintain their disposition on the common longitudinal axis, wherein the rotating causes periodically interfittment of each set of cooperating cylinder and piston members where their respective paths intersect; and supplying a combustible fluid in the cylinder member for detonation responsive to the members' interfittment in engine operating relation.

17. The method of claim 16, further comprising driving rotation of each member with a respective sprocket and belt assembly carried by its respective carrier wheel.

18. The method of claim 16, further comprising supplying air in the cylinder member to at least one of purge exhaust gases or supercharge combustion gases.

19. The method of claim 16, further comprising detonating, by a combustible fluid detonator coupled to the piston member, the combustible fluid while the piston member is positioned within a corresponding cylinder member.

20. The method of claim 16, further comprising providing a sealing system coupled to one of: each of the cylinder members or each of the piston members, the sealing system comprising a non-metallic flexible seal.

* * * * *